US009897371B2

(12) United States Patent
Yang et al.

(10) Patent No.: US 9,897,371 B2
(45) Date of Patent: Feb. 20, 2018

(54) REFRIGERATOR

(71) Applicant: LG ELECTRONICS INC., Seoul (KR)

(72) Inventors: Changwoan Yang, Seoul (KR); Hyeongil Kim, Seoul (KR); Heonjae Jang, Seoul (KR); Booyoun Lee, Daegu (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 15/423,735

(22) Filed: Feb. 3, 2017

(65) Prior Publication Data

US 2017/0227280 A1 Aug. 10, 2017

(30) Foreign Application Priority Data

Feb. 5, 2016 (KR) ..... 10-2016-0015032

(51) Int. Cl.

| | |
|---|---|
| ***F25D 25/02*** | (2006.01) |
| ***F25D 11/02*** | (2006.01) |
| ***F25D 23/06*** | (2006.01) |
| ***A47B 88/41*** | (2017.01) |

(52) U.S. Cl.

CPC ..... *F25D 25/025* (2013.01); *A47B 88/41* (2017.01); *F25D 11/02* (2013.01); *F25D 23/067* (2013.01); *F25D 2323/021* (2013.01); *F25D 2400/06* (2013.01)

(58) Field of Classification Search

CPC ..... F25D 23/02; F25D 23/021; F25D 23/028; F25D 23/04; F25D 23/067; F25D 23/069; F25D 25/024; F25D 25/025; F25D 25/027; F25D 2323/02; F25D 2323/021; F25D 2323/06; F25D 2400/06

See application file for complete search history.

(56) References Cited

U.S. PATENT DOCUMENTS 1,899,171 A * 2/1933 Warren ..... F25D 25/027 126/340
2,966,388 A * 12/1960 Olive ..... F25D 25/024 312/333
3,643,464 A * 2/1972 Hilliker ..... F25C 1/24 312/292

(Continued)

FOREIGN PATENT DOCUMENTS

DE 4445319 A1 * 6/1996 ..... F25D 25/025
EP 0718574 A1 * 6/1996 ..... F25D 25/025

(Continued)

*Primary Examiner* — Andrew M Roersma
(74) *Attorney, Agent, or Firm* — Fish & Richardson P.C.

(57) ABSTRACT

A refrigerator that includes: a cabinet; a door that is coupled to the cabinet and that is configured to open or close an opening of the cabinet; a first drawer; a plurality of rollers, each of the plurality of rollers being coupled to a first side of the first drawer or a second side of the first drawer; a plurality of first support rails, each of the plurality of first support rails (i) being coupled to a first side of the storage compartment or a second side of the storage compartment and (ii) being configured to guide one or more of the plurality of rollers; a base that is located at a third side of the first drawer in the storage compartment and that is configured to move; and a withdrawal unit that is configured to move the base based on movement of the door is disclosed.

20 Claims, 18 Drawing Sheets

(56) References Cited

U.S. PATENT DOCUMENTS

| | | | | | |
|---|---|---|---|---|---|
| 4,087,140 | A * | 5/1978 | Linstromberg | F25C 5/005 | 312/273 |
| 2006/0218958 | A1* | 10/2006 | Rand | F25D 11/022 | 62/302 |
| 2010/0307186 | A1* | 12/2010 | Kwon | F25D 23/028 | 62/407 |
| 2014/0300264 | A1* | 10/2014 | Park | F25D 25/025 | 312/404 |
| 2017/0227281 | A1* | 8/2017 | Yang | F25D 25/025 | |

FOREIGN PATENT DOCUMENTS

| | | | | |
|---|---|---|---|---|
| EP | 2218992 | A2 * | 8/2010 | A47B 96/16 |
| JP | 09089439 | A * | 4/1997 | |
| JP | 11063806 | A * | 3/1999 | |

* cited by examiner (a)

(b)

(a)

(b)

REFRIGERATOR

CROSS-REFERENCE TO RELATED APPLICATION

The application claims priority under 35 U.S.C. § 119 and 35 U.S.C. § 365 to Korean Patent Application No. 10-2016-0015032, filed Feb. 5, 2016, the entire contents of which is hereby incorporated by reference.

TECHNICAL FIELD

The present application generally relates to technologies about a refrigerator.

BACKGROUND

A refrigerator is an electric home appliance to store food in a refrigerated state or in a frozen state.

In recent years, the capacity of refrigerators has increased, and a home bar, an ice maker, a shelf, or a door box has been mounted on the rear of a door of the refrigerator. In this type of refrigerator, when the door is closed, the components mounted on the rear of the door may interfere with a shelf or a drawer mounted in a storage compartment of a main body of the refrigerator.

In order to prevent this interference, the front end of a drawer mounted in the storage compartment (e.g., a refrigerating compartment or a freezing compartment) is located at a place spaced apart from the front of the main body by a predetermined distance.

SUMMARY

In general, one innovative aspect of the subject matter described in this specification can be embodied in a refrigerator including: a cabinet that includes a storage compartment and an opening on a first surface of the storage compartment; a door that is coupled to the cabinet and that is configured to open or close the opening; a first drawer that is located in the storage compartment and that is configured to store food; a plurality of rollers, each of the plurality of rollers being coupled to a first side of the first drawer or a second side of the first drawer; a plurality of first support rails, each of the plurality of first support rails (i) being coupled to a first side of the storage compartment or a second side of the storage compartment and (ii) being configured to guide one or more of the plurality of rollers; a base that is located at a third side of the first drawer in the storage compartment and that is configured to move between a first position and a second position; and a withdrawal unit that is configured to move the base between the first position and the second position based on movement of the door, wherein each of the base or the first drawer respectively includes either a connection protrusion or a protrusion insertion groove, the connection protrusion being coupled to the protrusion insertion groove based on a distance between the first drawer and the base, wherein, based on coupling between the connection protrusion and the protrusion insertion groove, the base is configured to move together with the first drawer, wherein each of the plurality of first support rails includes an inclined section that is configured to (i) guide one or more of the plurality of rollers and (ii) gradually change a height of the first drawer as one or more rollers of the plurality of rollers move in the inclined section, and wherein, based on the height of the first drawer, the connection protrusion is separated from the protrusion insertion groove.

The foregoing and other embodiments can each optionally include one or more of the following features, alone or in combination. In particular, one embodiment includes all the following features in combination. Each of the plurality of first support rails further includes: a first section that extends from a first portion of the inclined section. Each of the plurality of first support rails further includes: a second section that extends from a second portion of the inclined section. The connection protrusion protrudes from a first surface of the base and the protrusion insertion groove is located on a first surface of the first drawer. A first end of the first drawer is located in the storage compartment based on each of the plurality of rollers being located in at least one inclined section of the plurality of first support rails. The connection protrusion protrudes from the first surface of the first drawer and the protrusion insertion groove is located on the first surface of the base. A first end of the first drawer is located in the storage compartment based on one or more of the plurality of rollers being located in at least one inclined section of the plurality of first support rails. The refrigerator further includes a second drawer that is located at a fourth side of the first drawer in the storage compartment and that is configured to store food; a plurality of second rollers, each of the plurality of second rollers being coupled to a first side of the second drawer or a second side of the second drawer; a plurality of second support rails, each of the plurality of second support rails (i) being coupled to the first side of the storage compartment or the second side of the storage compartment and (ii) being configured to guide one or more of the plurality of second rollers; and a first connection unit that is configured to couple the first drawer to the second drawer based on the height of the first drawer. The first connection unit includes: a first connection member that is coupled to the first drawer, and a second connection member that is coupled to the second drawer, wherein, based on the first connection member and the second connection member being in a coupled state, the first drawer is coupled to the second drawer, and wherein, based on the first connection member and the second connection member being in an uncoupled state, the first drawer is separate from the second drawer. The second connection member includes: a protrusion support part that is located at a third side of the second drawer, and a connection protrusion that protrudes from a surface of the protrusion support part, and wherein the first connection member includes a protrusion insertion hole (i) that is located at a first side of the protrusion support part and (ii) into which the connection protrusion of the second connection member is inserted. The connection protrusion of the second connection member is separated from the protrusion insertion hole based on movement of one or more rollers moving into the inclined section of at least one of the plurality of the first support rails. The second connection member further includes: a hinge that is configured to support the connection protrusion of the second connection member, and wherein the connection protrusion is configured to elastically rotate with respect to the protrusion support part. In a first state, the connection protrusion of the second connection member is located in the protrusion insertion hole. In a second state, the connection protrusion of the second connection member is spaced apart from the protrusion insertion hole. The refrigerator further includes: a third drawer that is located at a fourth side of the second drawer in the storage compartment and that is configured to store food; a plurality of third rollers, each of the plurality of third rollers being coupled to a first side of the third drawer or a second side of the third drawer; a plurality of third support rails, each of the plurality of third support rails (i) being coupled to the first side of the storage compartment or the second side of the storage compartment and (ii) being configured to guide one or more of the plurality of third rollers, wherein each of the plurality of third support rails includes a third inclined section that is configured to (i) guide one or more of the plurality of third rollers and (ii) gradually change a third height of the third drawer as the third drawer moves in the third inclined section; and a second connection unit that is configured to couple the second drawer to the third drawer based on the third height of the third drawer. The withdrawal unit includes: a link that includes a first portion that is rotatably coupled to the door and a second portion that is rotatably coupled to the base.

In general, another innovative aspect of the subject matter described in this specification can be embodied in a refrigerator comprising: a cabinet that includes a storage compartment and an opening on a first surface of the storage compartment; a door that is coupled to the cabinet and that is configured to open or close the opening; a first drawer that is located in the storage compartment and that is configured to store food; a plurality of rollers, each of the plurality of rollers being coupled to a first side of the first drawer or a second side of the first drawer; a plurality of first support rails, each of the plurality of first support rails (i) being coupled to a first side of the storage compartment or a second side of the storage compartment and (ii) including an inclined section that is configured to: guide one or more of the plurality of rollers, and gradually change a height of the first drawer as one or more rollers of the plurality of rollers move in the inclined section; and a base that is located at a third side of the first drawer in the storage compartment and that is configured to, based on movement of the door, move between a first position and a second position, wherein each of the base or the first drawer respectively includes either a connection protrusion or a protrusion insertion groove, wherein, based on coupling between the connection protrusion and the protrusion insertion groove, the first drawer is configured to move together with the base, and wherein, based on the height of the first drawer, the connection protrusion is separated from the protrusion insertion groove.

The foregoing and other embodiments can each optionally include one or more of the following features, alone or in combination. In particular, one embodiment includes all the following features in combination. The refrigerator further includes: a withdrawal unit that is configured to move the base between the first position and the second position based on movement of the door. The refrigerator further includes:

a second drawer that is located at a fourth side of the first drawer in the storage compartment and that is configured to store food; a plurality of second rollers, each of the plurality of second rollers being coupled to a first side of the second drawer or a second side of the second drawer; a plurality of second support rails, each of the plurality of second support rails (i) being coupled to the first side of the storage compartment or the second side of the storage compartment and (ii) being configured to guide one or more of the plurality of second rollers; and a first connection unit that is configured to couple the first drawer to the second drawer based on the height of the first drawer. The refrigerator further includes: a third drawer that is located at a fourth side of the second drawer in the storage compartment and that is configured to store food; a plurality of third rollers, each of the plurality of third rollers being coupled to a first side of the third drawer or a second side of the third drawer; a plurality of third support rails, each of the plurality of third support rails (i) being coupled to the first side of the storage compartment or the second side of the storage compartment and (ii) being configured to guide one or more of the plurality of third rollers, wherein each of the plurality of third support rails includes a third inclined section that is configured to (i) guide one or more of the plurality of third rollers and (ii) gradually change a third height of the third drawer as the third drawer moves in the third inclined section; and a second connection unit that is configured to couple the second drawer to the third drawer based on the third height of the third drawer.

The subject matter described in this specification can be implemented in particular embodiments so as to realize one or more of the following advantages. Comparing to a conventional refrigerator, a refrigerator includes a drawer that is not withdrawn until a door of a refrigerator is completely opened.

In addition, based on movement of the door, multiple drawers of the refrigerator that are arranged at different heights in a storage compartment are simultaneously withdrawn or inserted. Thus, the refrigerator does not need to include an additional part such as a frame for holding multiple drawers.

The details of one or more examples of the subject matter described in this specification are set forth in the accompanying drawings and the description below. Other potential features, aspects, and advantages of the subject matter will become apparent from the description, the drawings, and the claim.

BRIEF DESCRIPTION OF THE DRAWINGS

Like reference numbers and designations in the various drawings indicate like elements.

DETAILED DESCRIPTION

Figure 1:
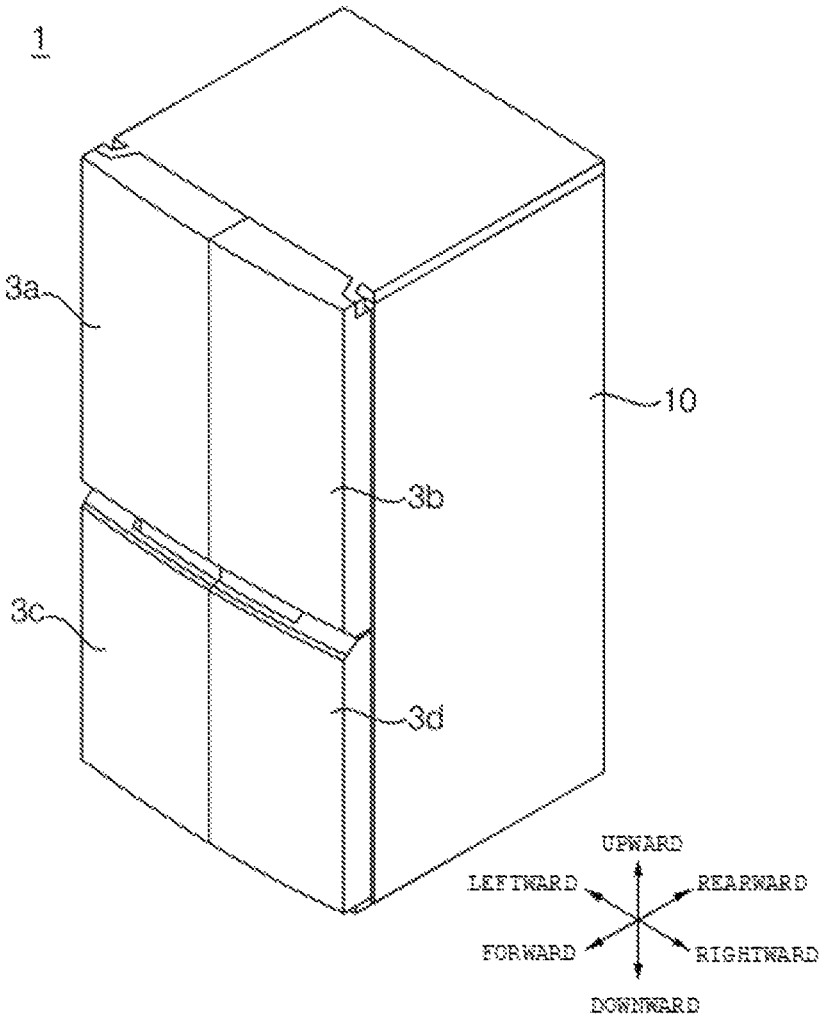
FIG. 1 is a diagram illustrating an example refrigerator.
Figure 2:
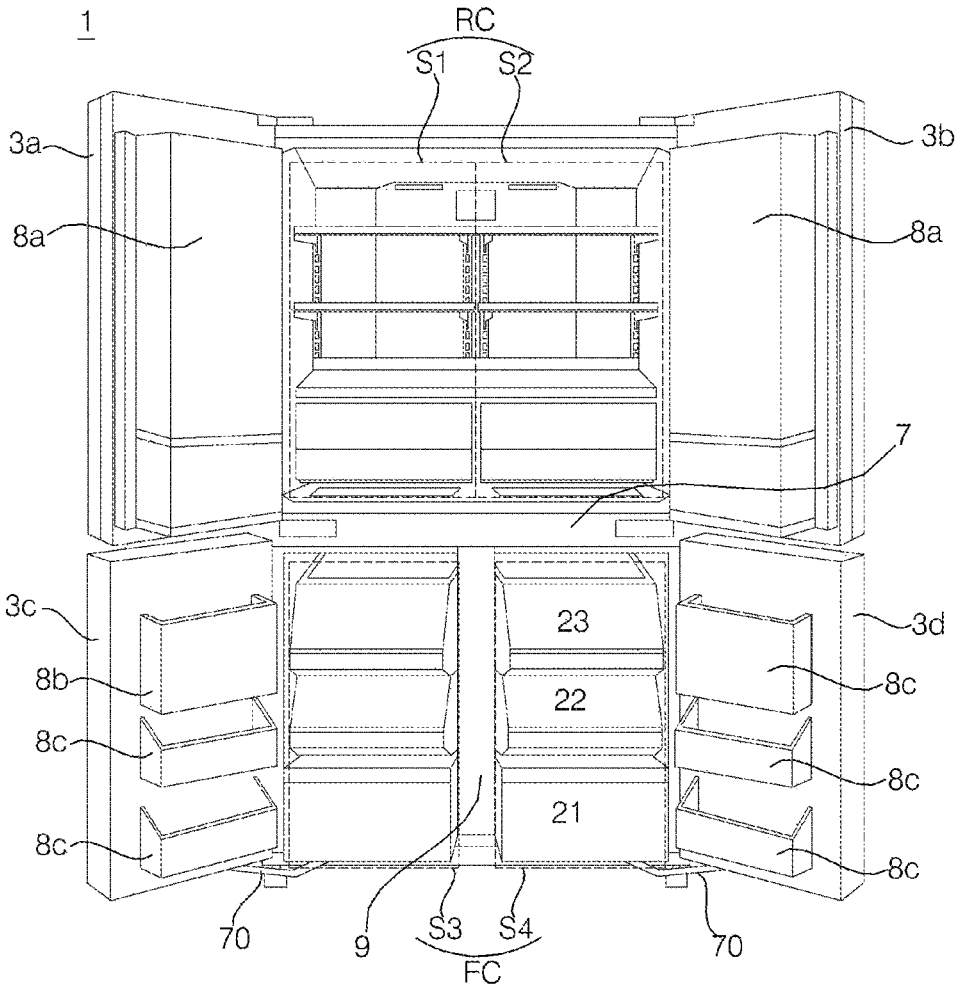
FIG. 2 is a diagram illustrating example doors of the refrigerator of FIG. 1.
Figure 3:
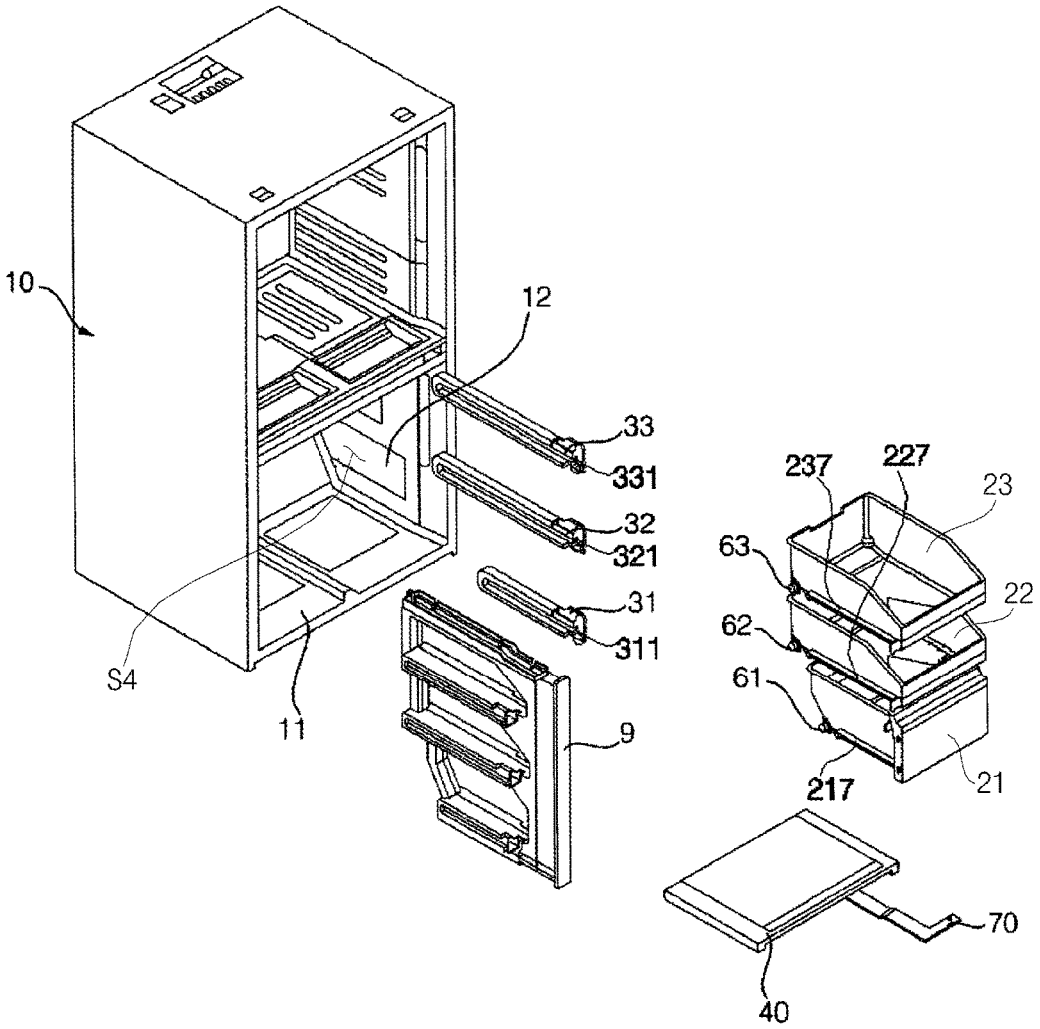
FIG. 3 is a diagram illustrating example drawers of a refrigerator.

FIG. 1 illustrates an example refrigerator. FIG. 2 illustrates example doors of the refrigerator of FIG. 1. FIG. 3 illustrates example drawers of a refrigerator. In FIG. 1, directions including "forward"/"rearward"/"leftward"/"rightward"/"upward"/"downward" are illustrated as an example.

Referring to FIGS. 1 to 3, a refrigerator 1 may include a cabinet 10 having compartments RC and FC (or storage compartments S1, S2, S3, and S4) defined therein and doors 3*a*, 3*b*, 3*c*, and 3*d* for opening and closing the compartments RC and FC. The doors 3*a*, 3*b*, 3*c*, and 3*d* may be hinged to the cabinet 10.

The front surfaces of the compartments RC and FC are open such that food is introduced and removed through the front surfaces of the compartments RC and FC. The open front surfaces of the compartments RC and FC may be opened and closed by the doors 3*a*, 3*b*, 3*c*, and 3*d*. Cool air is supplied into the compartments RC and FC. The compartments RC and FC may be sealed by the doors 3*a*, 3*b*, 3*c*, and 3*d* such that cool air does not leak from the compartments RC and FC. In some implementations, two or more compartments RC and FC may be provided. For a bottom freezer type refrigerator, the cabinet 10 is partitioned into the upper part and the lower part, and the compartments RC and FC are respectively provided in the upper part and the lower part of the cabinet 10. For example, the lower compartment FC can be a freezing compartment and the interior temperature of which can be maintained below 0° C. The upper compartment RC can be a refrigerating compartment and the interior temperature of which can be maintained above 0° C. In this specification, a "compartment" can be a refrigerating compartment or a freezing compartment.

Each of the compartments RC and FC may be opened and closed by a pair of doors. For example, the refrigerating compartment RC may be opened and closed by a pair of refrigerating compartment doors 3*a* and 3*b*, and the freezing compartment FC may be opened and closed by a pair of freezing compartment doors 3*c* and 3*d*.

The storage compartments S1, S2, S3, and S4 constitute all or portions of the compartments RC and FC. The storage compartments S1, S2, S3, and S4 may be defined as regions that are opened and closed by the doors 3*a*, 3*b*, 3*c*, and 3*d*. The refrigerating compartment RC may include a storage compartment S1, the open front surface of which is opened and closed by a left refrigerating compartment door 3*a*, and a storage compartment S2, the open front surface of which is opened and closed by a right refrigerating compartment door 3*b*. Hereinafter, the storage compartment S1 may be referred to as a left refrigerating storage compartment and the storage compartment S2 may be referred to as a right refrigerating storage compartment as needed.

In the same manner, the freezing compartment FC may include a storage compartment S3, the open front surface of which is opened and closed by a left freezing compartment door 3*c*, and a storage compartment S4, the open front surface of which is opened and closed by a right freezing compartment door 3*d*. Hereinafter, the storage compartment S3 may be referred to as a left freezing storage compartment and the storage compartment S4 may be referred to as a right freezing storage compartment as needed.

In the case in which two storage compartments are provided in one compartment in the horizontal direction, as described above, the storage compartments may communicate with each other. For example, when the refrigerating compartment RC is viewed from the front, the left refrigerating storage compartment S1 and the right refrigerating storage compartment S2 are not partitioned from each other. Consequently, cool air may freely flow between the left refrigerating storage compartment S1 and the right refrigerating storage compartment S2.

In some implementations, a vertical partition 9 is provided between the left freezing storage compartment S3 and the right freezing storage compartment S4 of the freezing compartment FC, unlike the refrigerating compartment RC. As a result, the storage compartments S3 and S4 are partitioned from each other. Even in this case, however, the flow of cool air between the storage compartments S3 and S4 may not be completely blocked by the vertical partition 9. For example, the vertical partition 9 may be provided with through holes, through which the storage compartments S3 and S4 communicate with each other.

In the case in which one space is partitioned into two parts by the vertical partition 9 to form two storage compartments S3 and S4 in the horizontal direction, as in the freezing compartment FC, the bottom surface of each of the storage compartments S3 and S4 may be defined by the inner bottom surface 11 of the cabinet 10. The upper surface of each of the storage compartments S3 and S4 may be defined by the bottom surface of a horizontal partition 7, which partitions the refrigerating compartment RC and the freezing compartment FC from each other. One of the side surfaces of each of the storage compartments S3 and S4 may be defined by an inner surface 12 of the cabinet 10, and the other side surface of each of the storage compartments S3 and S4 may be defined by one surface of the vertical partition 9 that faces the inner surface 12 of the cabinet 10.

In some implementations, the refrigerating compartment RC can be partitioned into a pair of storage compartments by the vertical partition. For example, one of the side surfaces of each of the storage compartments S1 and S2 constituting the refrigerating compartment RC may be defined by the inner surface 12 of the cabinet 10, and the other side surface of each of the storage compartments S1 and S2 may be defined by one surface of the vertical partition 9 that faces the inner surface 12 of the cabinet 10.

Referring to FIG. 2, the doors 3*a*, 3*b*, 3*c*, and 3*d* may be provided corresponding to the storage compartments S1, S2, S3, and S4, respectively. A door storage unit for storing food may be formed in the rear parts of the doors 3*a*, 3*b*, 3*c*, and 3*d*, i.e., the parts of the doors 3*a*, 3*b*, 3*c*, and 3*d* that face the open front surfaces of the storage compartments S1, S2, S3, and S4. The door storage unit may include storage chambers 8*a* for storing food that is frequently taken out of the refrigerator, such as dairy products, beverages, vegetables, etc., a tray 8*b* for storing ice, and baskets 8*c* for storing small-sized frozen food. In the state in which the doors 3*a*, 3*b*, 3*c*, and 3*d* are closed, at least a portion of the door storage unit 8*a*, 8*b*, and 8*c* may be located in the storage compartments S1, S2, S3, and S4.

Referring to FIGS. 2 and 3, at least one drawer may be disposed in the compartments RC and FC or the storage compartments S1, S2, S3, and S4. The drawer is provided to store or hold food. A plurality of drawers 21, 22, and 23 may be arranged in the upward-downward direction. Each of the drawers 21, 22, and 23 has therein a predetermined sized space for storing food. Rollers 61, 62 and 63 may be provided at opposite sides of the drawers 21, 22, and 23. The rollers 61, 62 and 63 are rotated about rotation shafts protruding from the drawers 21, 22, and 23 in the lateral direction of the storage compartments S1, S2, S3, and S4. In addition, the rollers 61, 62 and 63 are supported and guided such that the rollers 61, 62 and 63 are movable along support rails 31, 32, and 33, a description of which will follow, in the forward-rearward direction.

At least one drawer may be provided in the storage compartments S1, S2, S3, and S4. Hereinafter, three drawers 21, 22, and 23 will be described as being disposed in the right freezing storage compartment S4 so as to be arranged at different heights in the upward-downward direction, which, however, is merely illustrative. The following description is also applicable to the other storage compartments S1, S2, and S3.

Figure 4:
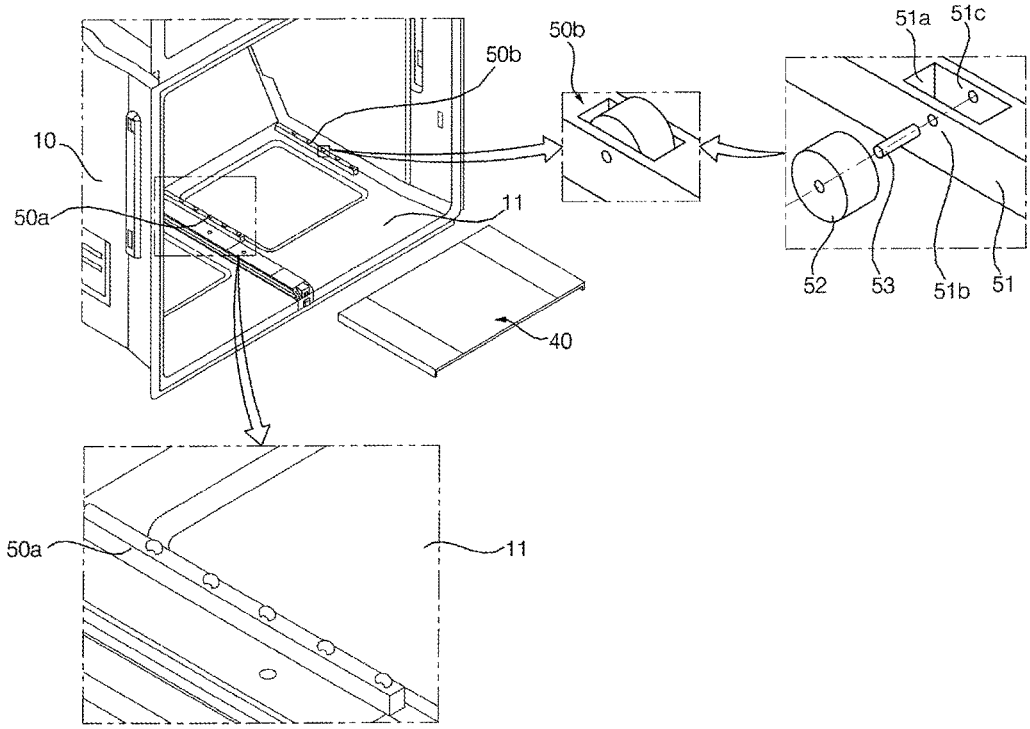
FIG. 4 is a diagram illustrating the example drawers of the refrigerator in FIG. 3.
Figure 5:
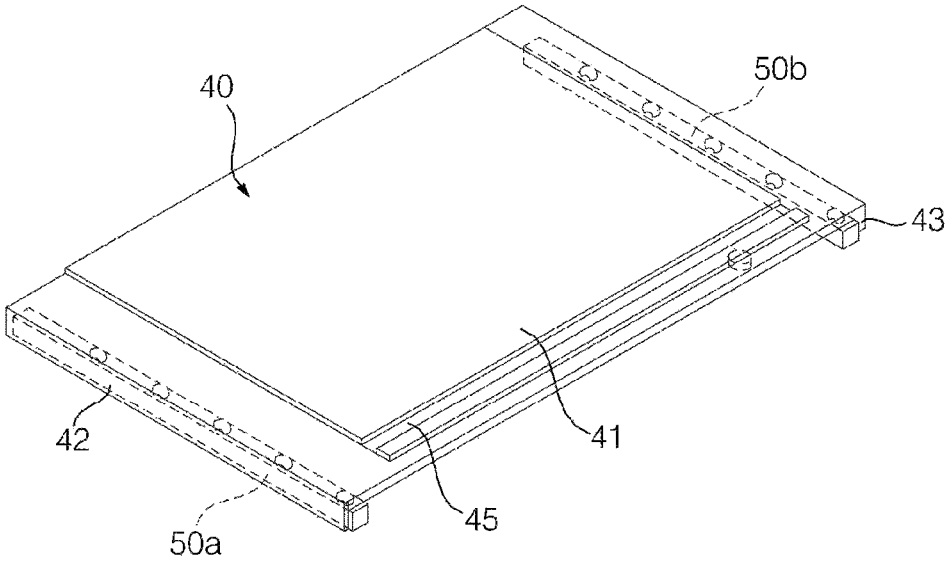
FIG. 5 is a diagram illustrating an example assembly including an example base and an example base guide.

FIG. 4 illustrates example drawers of the refrigerator in FIG. 3. FIG. 5 illustrates an example assembly including an example base and an example base guide. Referring to FIGS. 4 and 5, the first drawer 21, the second drawer 22, and the third drawer 23 are sequentially arranged from below in the storage compartment S4. In the storage compartment S4, pairs of support rails 31, 32, and 33 are provided so as to respectively correspond to the drawers 21, 22, and 23. The support rails 31, 32, and 33 may include a pair of first support rails 31 for supporting opposite sides of the first drawer 21, a pair of second support rails 32 for supporting opposite sides of the second drawer 22, and a pair of third support rails 33 for supporting opposite sides of the third drawer 23.

The drawers 21, 22, and 23 are respectively supported by the support rails 31, 32, and 33, which are fixed in the storage compartment S4. Specifically, rollers 61, 62, and 63, provided at the opposite sides of the drawers 21, 22, and 23, are respectively supported by the support rails 31, 32, and 33 provided at the opposite sides of the drawers 21, 22, and 23.

In addition, the support rails 31, 32, and 33 may be respectively provided with rollers 311, 321, and 331. The drawers 21, 22, and 23 may be respectively provided at the opposite sides thereof with guide ribs 217, 227, and 237, which extend in the forward-rearward direction so as to be respectively supported by the rollers 311, 321, and 331. The rollers 311, 321, and 331 are respectively provided to balance the drawers 21, 22, and 23. The rollers 311, 321, and 331 may be disposed before the rollers 61, 62, and 63 so as to respectively support the guide ribs 217, 227, and 237. The rollers 61, 62, and 63, provided at the drawers 21, 22, and 23, are respectively supported by the support rails 31, 32, and 33, and the guide ribs 217, 227, and 237, provided at the drawers 21, 22, and 23, are respectively supported by the rollers 311, 321, and 331, provided at the support rails 31, 32, and 33, whereby the drawers 21, 22, and 23 are balanced. In particular, each of the guide ribs 217 and 237, provided at the drawers 21 and 23, may be configured to have an appropriate shape such that the drawers 21 and 23 are balanced even when the heights of the rollers 61 and 63, provided at the drawers 21 and 23, are changed after the rollers 61 and 63 respectively pass inclined sections S12 and S13, a description of which will follow, while the rollers 61 and 63 respectively move along the first support rails 31 and the third support rails 33. For example, the guide ribs 217 may be provided with inclined parts corresponding to the inclined sections S12 (i.e., parts that are gradually inclined upward from the rear to the front). While the rollers 61, provided at the first drawer 21, move upward along the inclined sections S12, therefore, the inclined parts of the guide ribs 217 pass the rollers 311, whereby not only the rear part of the drawer 21, supported by the rollers 61 but also the front part of the drawer 31, at which the guide ribs 217 are supported, move upward. As a result, the drawer 21 may be balanced. This structure may be applied to the guide ribs 237 formed at the third drawer 23.

In some implementations, the guide ribs 217 and 237 can be different from the example described above. For example, the guide ribs 217 and 237 may be entirely horizontal. In this example, at least portions of the drawers 21 and 23 may ascend while the rollers 61 and 63 move along the inclined sections S12 and S32, even though the guide ribs 217 and 237 are always move horizontally. The connection and disconnection between the drawers 21, 22, and 23 may be performed by partial ascent of the drawers 21 and 23, even though the drawers 21 and 23 are slightly inclined.

Figure 6:
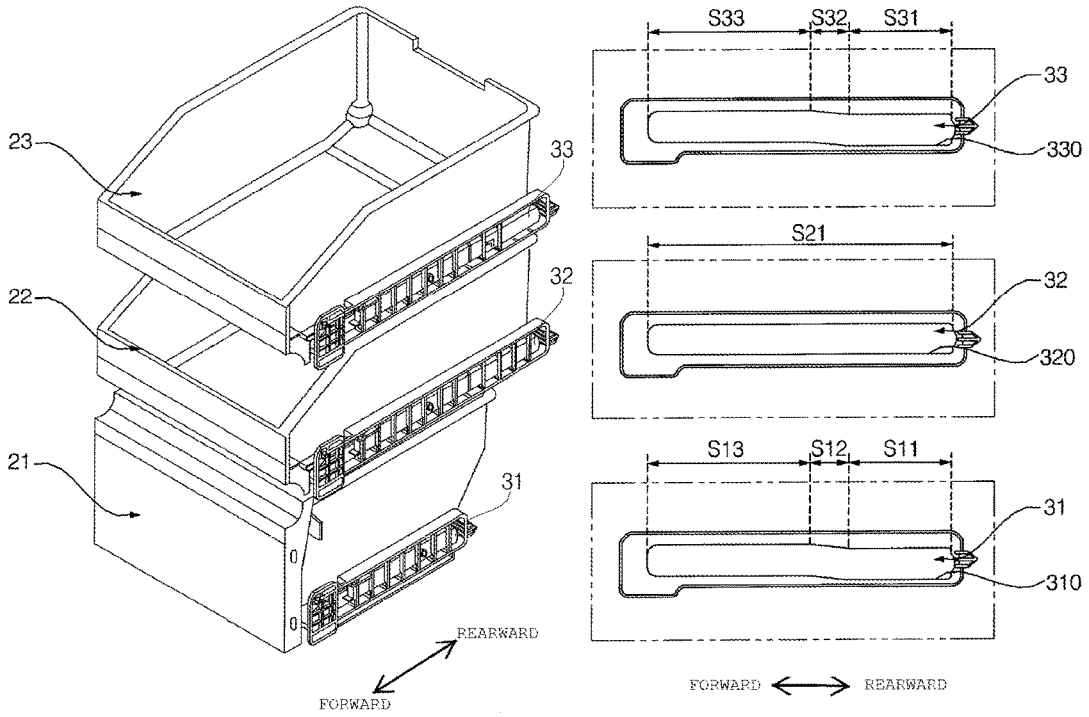
FIG. 6 is a diagram illustrating example drawers and example support rails.

In some implementations, the second support rails 32 are substantially entirely horizontal (see FIG. 6). In response thereto, the guide ribs 227, provided at the second drawer 22, may be substantially entirely horizontal.

In some implementations, one of each pair of the support rails 31, 32, and 33, which respectively correspond to the drawers 21, 22, and 23, is fixed to the inner surface 12 of the cabinet 10, and the other is fixed to the vertical partition 9, which faces the inner surface 12 of the cabinet 10. For a refrigerator configured such that a single compartment is opened and closed by a single door, the support rails may be fixed to opposite inner surfaces of the cabinet. In some implementations, in FIG. 3, one of each pair of the support rails 31, 32, and 33, which respectively correspond to the drawers 21, 22, and 23, is shown as being disposed at the inner surface 12 of the cabinet 10. Of course, the other of each pair of the support rails 31, 32, and 33 is disposed at one surface of the vertical partition 9, which faces the inner surface 12 of the cabinet 10.

In the storage compartment S4, a base 40 may be provided at the lower side of the first drawer 21. The base 40 is configured to move in response to the opening and closing operation of the door 3*d*. When the door 3*d* is opened, the base 40 moves forward. When the door 3*d* is closed, the base 40 moves rearward.

The base 40 may include a plate 41 (see FIG. 5) having a top surface, which faces the bottom surface of the first drawer 21, and a pair of legs 42 and 43 protruding downward from the plate 41 and extending in the forward-rearward direction.

In some implementations, the plate 41 can be flat. A protrusion insertion groove 45, into which a connection protrusion 215 formed on the first drawer 21 is inserted, may be formed in the top surface of the plate 41. The protrusion insertion groove 45 may extend in the lateral direction of the plate 41. The protrusion insertion groove 45 may be provided so as to be adjacent to the front end of the plate 41.

As shown in FIGS. 4 and 5, the legs 42 and 43 may be spaced apart from each other by a predetermined distance in the lateral direction of the plate 41 so as to be parallel to each other. A pair of base guides 50*a* and 50*b*, which are spaced apart from each other in the lateral direction of the storage compartment S4, may be disposed at the bottom surface 11 of the storage compartment S4 so as to be parallel to each other. The first leg 42 may be disposed between the vertical partition 9 and the first base guide 50*a*, and the second leg 43 may be disposed between the inner surface 12 of the cabinet 10 and the second base guide 50*b*.

Each of the base guides 50*a* and 50*b* may include a guide body 51 extending in the forward-rearward direction and at least one roller 52 rotatably provided at the guide body 51. The guide body 51 is provided with a plurality of roller installation recesses 51*a*, which are arranged in the forward-rearward direction. The rollers 52 may be rotatably connected to a rotation shaft 53, which extend through opposite sidewalls 51*b* and 51*c* of the roller installation recesses 51*a* in the state of being inserted into the roller installation recesses 51*a*. The rollers 52 may be installed in the respective roller installation recesses 51*a* such that the plate 41 is supported by the rollers 52.

A withdrawal unit may be provided to move the base 40 in response to the operation of the door 3*d*. That is, the withdrawal unit may be configured to move the base 40 depending on the opening angle of the door 3*d*. When the door 3*d* is opened, the withdrawal unit may move the base 40 forward. When the door 3*d* is closed, the withdrawal unit may move the base 40 rearward. The opening angle of the door 3*d* is measured on the basis of the state in which the door 3*d* is completely closed. As the opening angle of the door 3*d* is increased (i.e., as the door 3*d* is turned in the direction in which the door 3*d* is opened), the base 40 moves forward. As the opening angle of the door 3*d* is decreased (i.e., as the door 3*d* is turned in the direction in which the door 3*d* is closed), the base 40 moves rearward.

Figure 11:
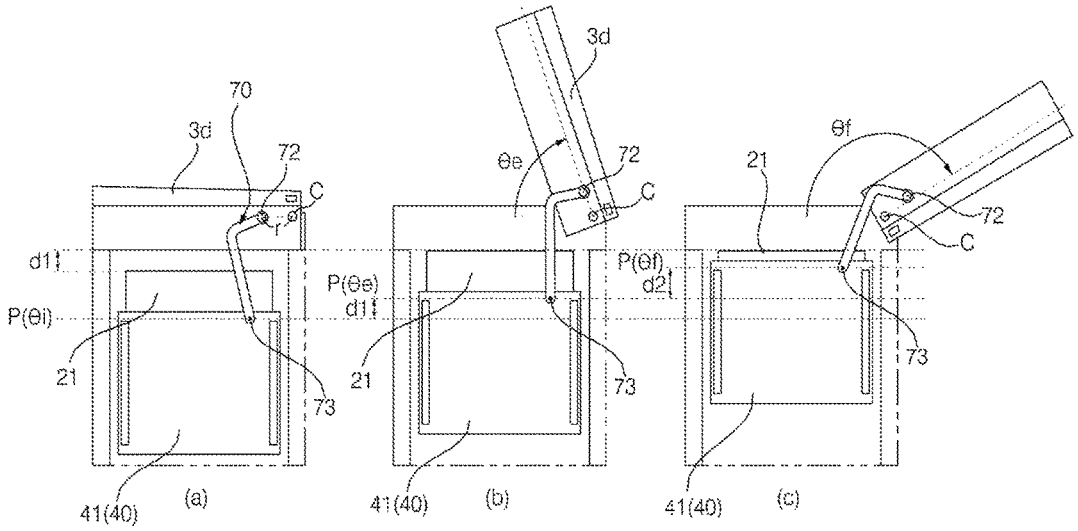
FIG. 11 is a diagram illustrating an example base.

In some implementations, the withdrawal unit may include a link 70, the front end of which is rotatably connected to the door 3*d* and the rear end of which is rotatably connected to the base 40. In FIG. 11, reference numerals 72 and 73 respectively indicate a front-end rotation shaft and a rear-end rotation shaft of the link 70.

Referring to FIG. 11, the front end of the link 70 is coupled to the door 3*d* at a position spaced apart from a rotation shaft C of the door 3*d* with respect to the cabinet 10 by a predetermined distance r. When the door 3*d* is turned, therefore, the front-end rotation shaft 72 of the link 70 moves along a circle having the rotation shaft C of the door 3*d* as the center and the distance r as the radius. At this time, the rear-end rotation shaft 73 is also displaced. Consequently, the base 40, which is connected to the rear-end rotation shaft 73, also moves.

In other implementations, the withdrawal unit may include a driving unit, such as an electric motor or an electric actuator, and a power conversion unit for transferring power generated from the driving unit to the base 40 to move the base 40 in the forward-rearward direction. For example, in the case in which a rotary motor is provided as the driving unit, the power conversion unit may include a rack and pinion or a crank, which converts the rotational force of the motor into a rectilinear motion.

Figure 7:
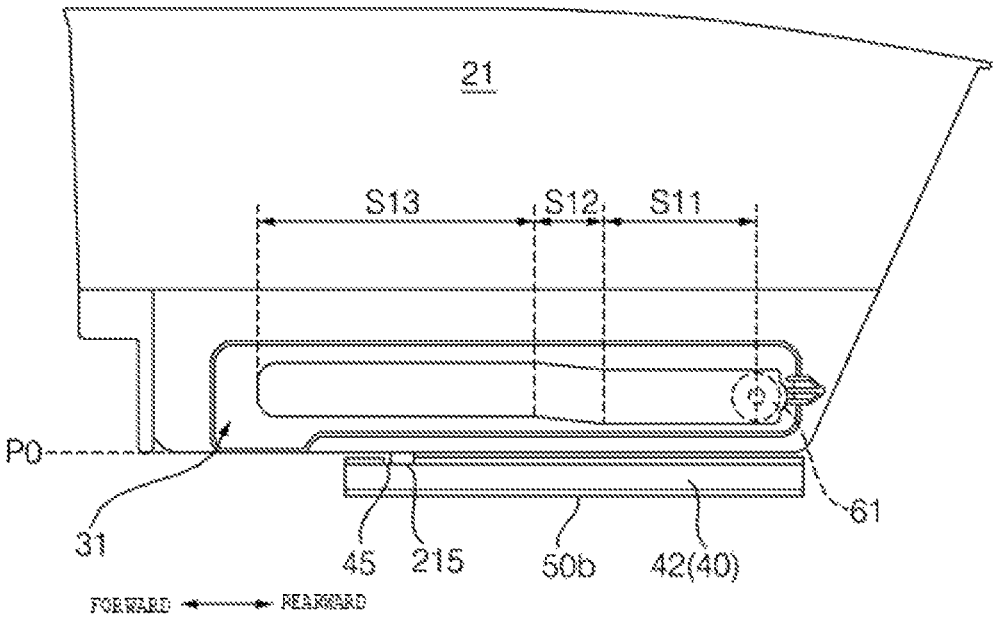
FIG. 7 is a diagram illustrating an example first drawer and an example base when a door of a refrigerator is closed.
Figure 8:
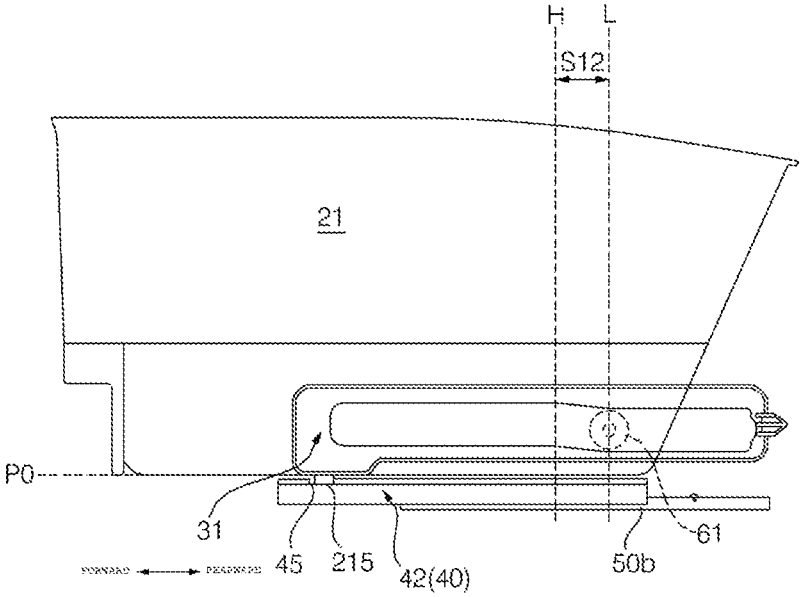
FIG. 8 is a diagram illustrating an example first drawer and an example base when a door of a refrigerator is being opened.
Figure 9:
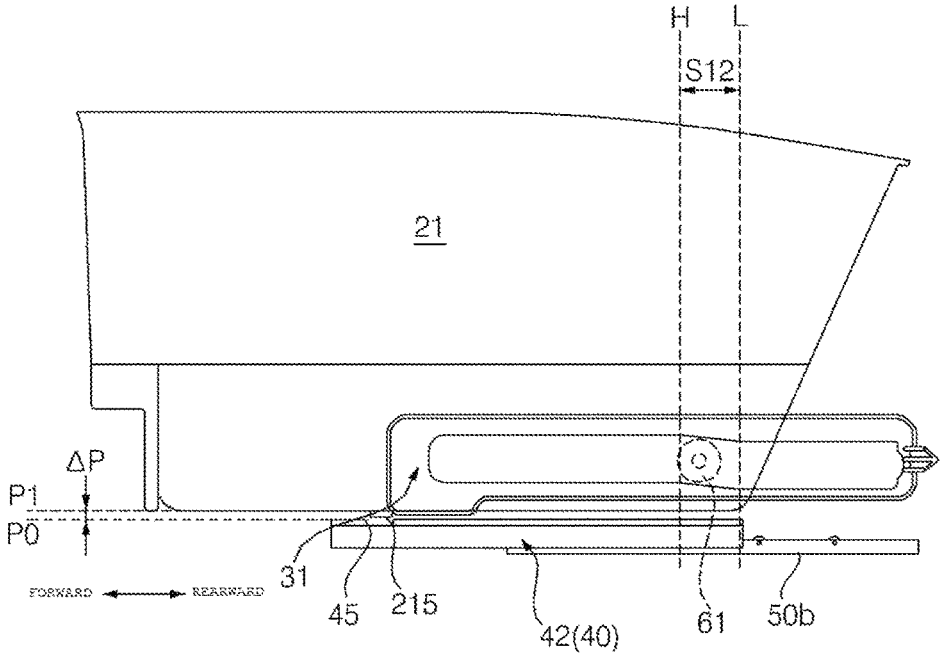
FIG. 9 is a diagram illustrating an example first drawer and an example base when a door of a refrigerator is being opened to a separation angle.
Figure 10:
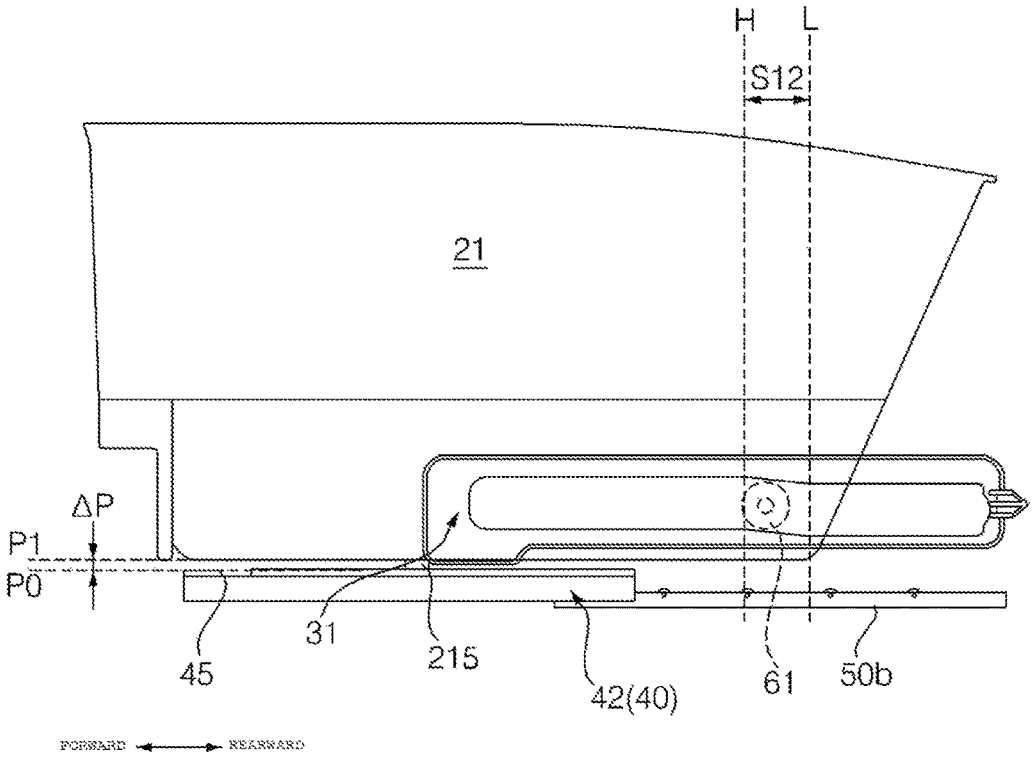
FIG. 10 is a diagram illustrating an example first drawer and an example base when a door of a refrigerator is fully open.

FIG. 6 illustrates example drawers and example support rails. FIG. 7 illustrates an example first drawer and an example base when a door of a refrigerator is closed. FIG. 8 illustrates an example first drawer and an example base when a door of a refrigerator is being opened. FIG. 9 illustrates an example first drawer and an example base when a door of a refrigerator is being opened to a separation angle θe. FIG. 10 illustrates an example first drawer and an example base when a door of a refrigerator is fully open. FIG. 11 illustrates an example base.

In FIG. 11, P(θi) indicates the position of the rear-end rotation shaft 73 of the link 70 in the state in which the door 3*d* is closed, P(θe) indicates the position of the rear-end rotation shaft 73 of the link 70 in the state in which the door 3*d* is open to the separation angle θe, and P(θf) indicates the position of the rear-end rotation shaft 73 of the link 70 in the state in which the door 3*d* is fully open.

If the base 40 and the first drawer 21 are connected to each other via a predetermined connection unit, the first drawer 21 may move forward together with the base 40 when the door 3*d* is opened. However, the base 40 continuously move forward until the door 3*d* is completely open. Therefore, the first drawer 21 also continuously moves forward until the door 3*d* is completely open. As a result, a portion of the first drawer 21 may unnecessarily protrude out of the cabinet 10 beyond the front surface of the storage compartment S4.

A user does not always open the door 3*d* in order to put food in the first drawer 21 or to take food out of the first drawer 21. For example, the door 3*d* may be opened to take food out of the door storage unit 8*c* or to withdraw other drawers 22 and 23. Consequently, it is necessary to restrict a moving distance of the first drawer 21 when the door 3*d* is opened.

For this reason, it is necessary to configure the connection unit such that, when the base 40 is withdrawn by the link 70 and reaches a predetermined position, the first drawer 21 cannot be withdrawn any further, whereby the base 40 and the first drawer 21 are separated from each other. In the refrigerator 1, the connection unit includes a connection protrusion 215 formed on one of the first drawer 21 and the base 40 and a protrusion insertion groove 45 formed in the other of the first drawer 21 and the base 40. The connection protrusion 215 is engaged with or inserted into the protrusion insertion groove 45, and the coupling between the connection protrusion 215 and the protrusion insertion groove 45 is released when the first drawer 21 moves higher than a predetermined height. In the following description, the connection protrusion 215 and the protrusion insertion groove 45 are arranged in the upward-downward direction. In addition, the protrusion insertion groove 45 is formed in a top surface of the plate 41, and the connection protrusion 215 protrudes downward from the bottom surface of the first drawer 21. Alternatively, the protrusion insertion groove 45 may be formed in the first drawer 21, and the connection protrusion 215 may be formed on the plate 41.

In the state in which the door 3*d* is closed, the connection protrusion 215 of the first drawer 21 is located in the protrusion insertion groove 45. As will be described hereinafter in more detail, the first drawer 21 may be located at a certain position in the state in which the door 3*d* is open, but the connection protrusion 215 is engaged with or inserted into the protrusion insertion groove 45 while the door 3*d* is closed, with the result that the base 40 and the first drawer 21 simultaneously return to the original positions thereof. In the state in which the door 3*d* is closed, therefore, the coupling between the connection protrusion 215 and the protrusion insertion groove 45 is maintained.

In some implementations, the first support rails 31 are configured such that, when the rollers 61 pass specific sections while the first drawer 21 moves forward, the rollers 61 ascend by at least a predetermined height ΔP (see FIG. 9). Each of the first support rails 31 may include a rear horizontal section S11, an inclined section S12, and a front horizontal section S13, which are sequentially arranged from the rear to the front.

Each of the first support rails 31 may include a roller guide groove 310 formed in the surface thereof that faces the first drawer 21 so as to extend in the forward-rearward direction. A corresponding one of the rollers 61 is inserted into the roller guide groove 310. The sections S11, S12, and S13 may define support surfaces for supporting the lower side of the roller 61 in the roller guide groove 310. That is, the support surfaces of the rear horizontal section S11 and the front horizontal section S13, which support the lower side of the roller 61, may horizontally extend in the forward-rearward direction, and the support surface of the inclined section S12 may be gradually inclined upward from the rear to the front.

When the door 3*d* starts to be opened from the closed state, the base 40 is moved forward by the link 70. At this time, the base 40 and the first drawer 21 are interlocked, since the connection protrusion 215 is located in the protrusion insertion groove 45. Consequently, the roller 61 of the first drawer 21 rolls forward along the rear horizontal section S11 (from FIG. 7 to FIG. 8). The height of the first drawer 21 at this time is denoted by P0 in FIGS. 7 to 9.

When the door 3*d* is continuously turned and the opening angle of the door 3*d* reaches a predetermined angle (hereinafter, referred to as an "ascent start angle"), the roller 61 enters the inclined section S12 (see FIG. 8). From this time, the roller 61 rolls along the inclined section S12, with the result that the height of the first drawer 21 is increased. For example, the ascent start angle may be 50 degrees or more. In some other implementations, the ascent start angle can be set differently.

Subsequently, as shown in FIG. 9, the door 3*d* is opened further, and the roller 61 of the first drawer 21 continuously rolls along the inclined section S12. As the height of the first drawer 21 is increased, the height of the connection protrusion 215 is increased. When the first drawer 21 ascends to a predetermined height P1 (hereinafter, referred to as a "separation height"), the connection protrusion 215 is completely separated from the protrusion insertion groove 45. For reference, in the drawings, "L" indicates the position of the roller 61 when the roller 61 enters the inclined section S12 (i.e., the position of the rear end of the inclined section S12), and "H" indicates the position of the roller 61, having ascended to the maximum height along the inclined section S12 (i.e., the position of the front end of the inclined section S12).

In some implementations, when the connection protrusion 215 is completely separated from the protrusion insertion groove 45, the opening angle θe (hereinafter, referred to a "separation angle") of the door 3*d* does not exceed 90 degrees. In some other implementations, the opening angle θe can be set more than 90 degrees.

The distance d1 (see FIG. 11) that the roller 61 moves forward until the door 3*d* is opened to the separation angle θe from the closed state is set within a range in which the front end of the first drawer 21 does not pass beyond the front surface of the storage compartment S4. Here, the distance dl is the distance that the first drawer 21 is automatically withdrawn by the base 40 when the door 3*d* is opened even when the user does not directly pull the drawer 21.

When the door 3*d* is opened to the separation angle θe, i.e., when the connection protrusion 215 is separated from the protrusion insertion groove 45, the roller 61 may be located within the inclined section S12. When the door 3*d* is continuously opened even after the connection protrusion 215 is separated from the protrusion insertion groove 45, the base 40 moves further forward. Since the first drawer 21 is disconnected from the base 40, however, the roller 61 descends rearward along the inclined section S12 by a predetermined distance, with the result that the connection protrusion 215 remains in contact with the top surface of the plate 41. When the door 3*d* is closed from the state in which the door 3*d* is open to the separation angle θe or more (see FIGS. 10 and 11(*c*)), therefore, the protrusion insertion groove 45 is arranged at the lower side of the connection protrusion 215 while the base 40 is moved rearward by the link 70, and then the connection protrusion 215 is inserted again into the protrusion insertion groove 45. From this time, the first drawer 21 moves rearward together with the base 40 and returns to the original position thereof until the door 3*d* is completely closed.

The front horizontal section S13 may extend forward from the front end of the inclined section S12. Since the first drawer 21 is disconnected from the base 40 while the roller 61 passes the inclined section S12, the first drawer 21 does not move any further, but only the base 40 continuously advances when the door 3*d* is further turned beyond the separation angle θe. In order to further withdraw the first drawer 21, therefore, it is necessary for the user to directly pull the first drawer 21. In this case, the roller 61 moves along the front horizontal section S13, whereby the first drawer 21 is further withdrawn.

Figure 12:
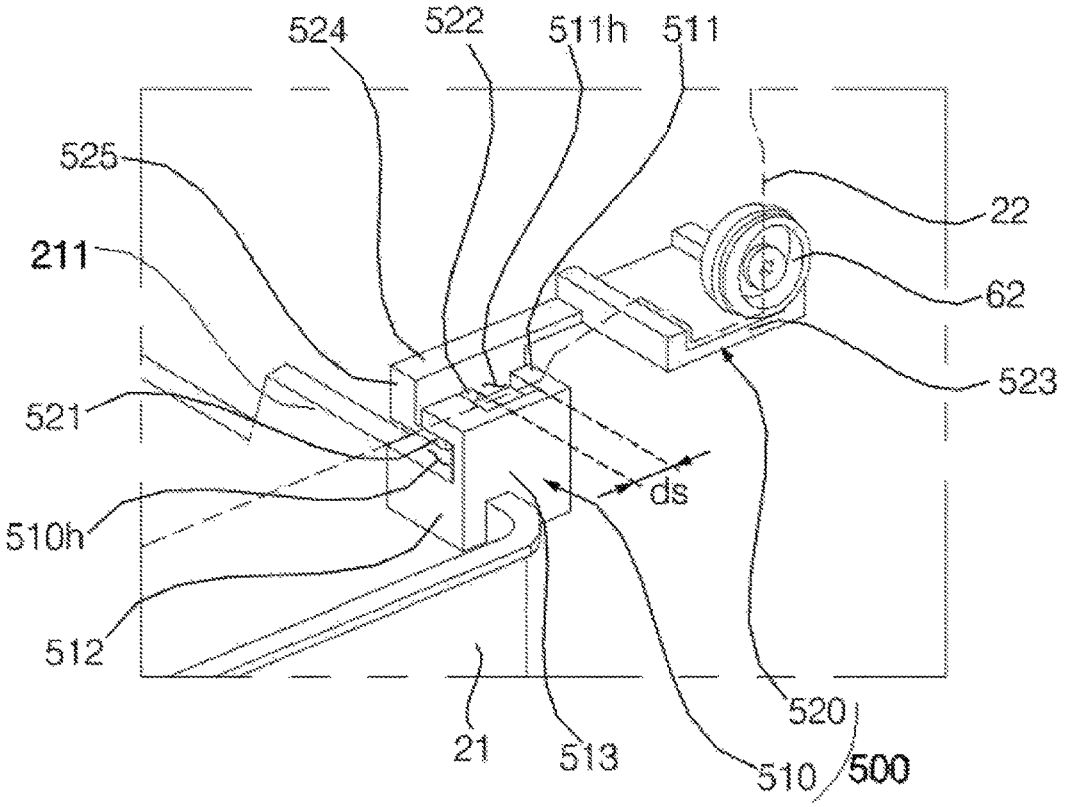
FIG. 12 is a diagram illustrating an example first connection unit.
Figure 13:
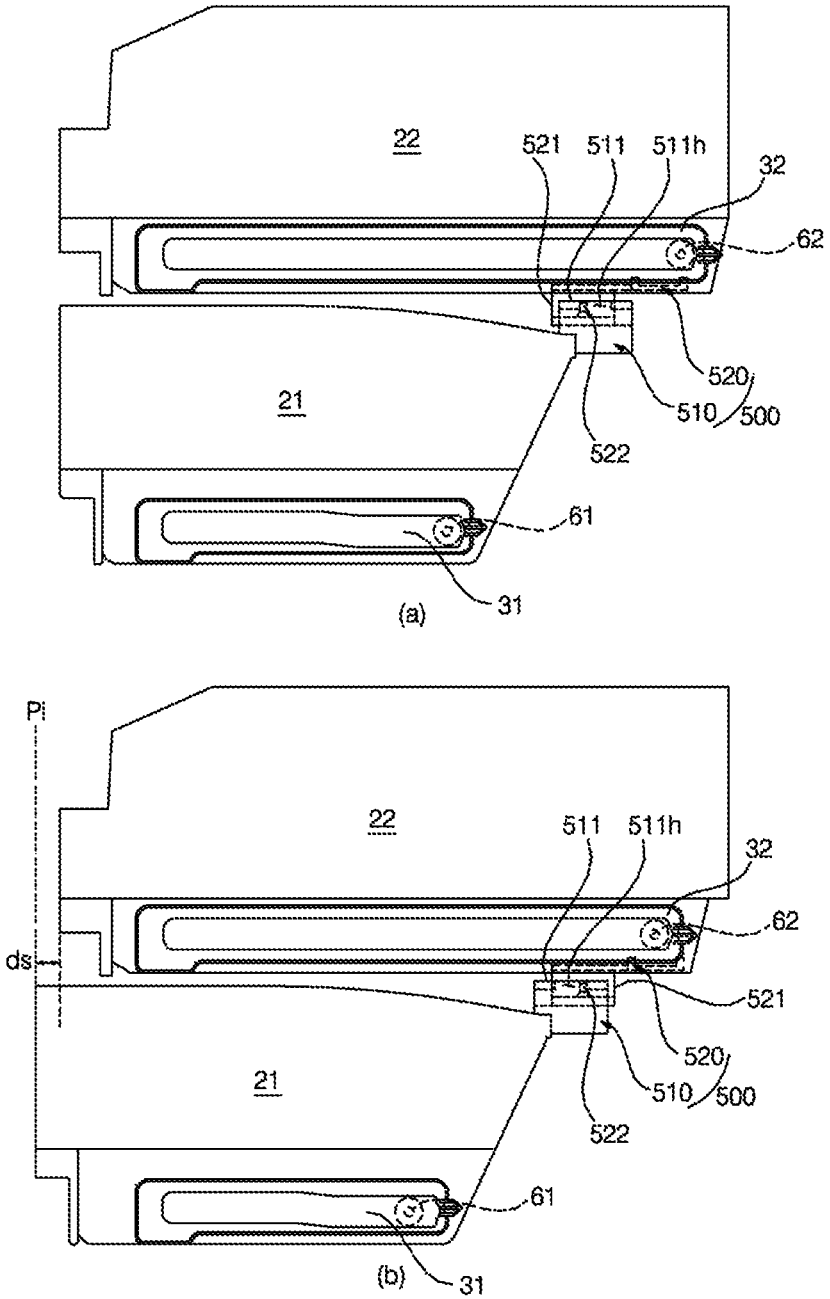
FIGS. 13(*a*) and 13(*b*) are diagrams illustrating an example first connection unit that couples a first drawer to a second drawer.
Figure 14:
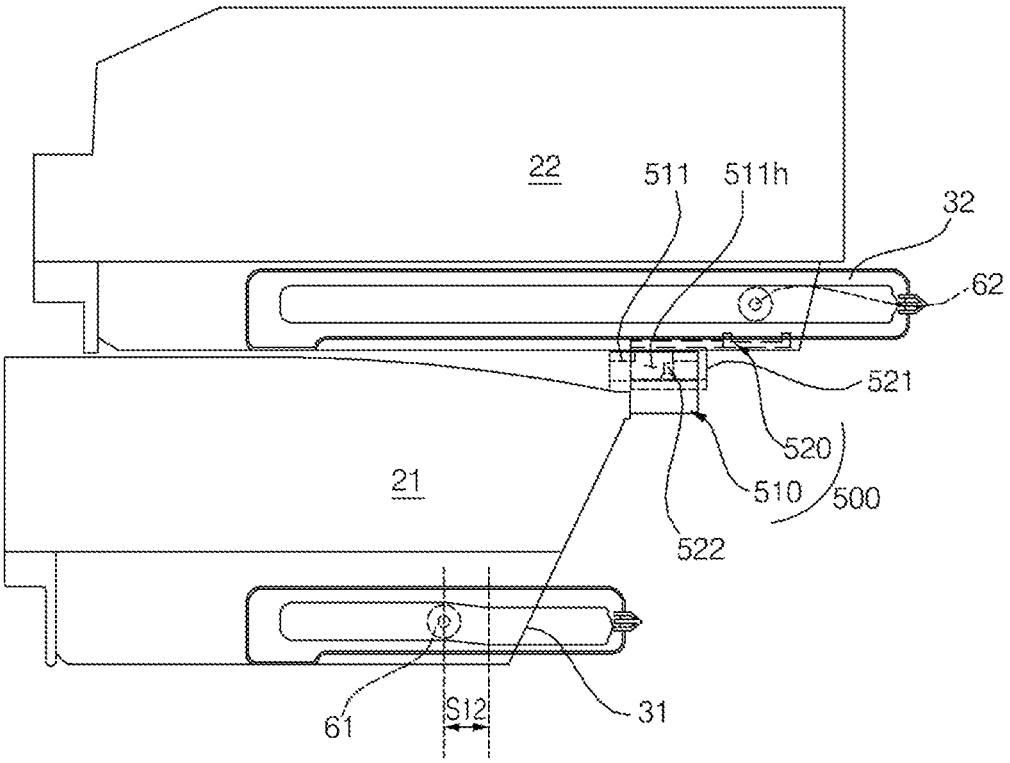
FIG. 14 is a diagram illustrating an example first drawer and an example second drawer when a door of a refrigerator is open to a separation angle.

FIG. 12 illustrates an example first connection unit. FIGS. 13(*a*) and 13(*b*) illustrate an example first connection unit that couples a first drawer to a second drawer. FIG. 14 illustrates an example first drawer and an example second drawer when a door of a refrigerator is open to a separation angle θe.

The second drawer 22 is supported and guided by the second support rails 32. Each of the second support rails 32 may include a roller guide groove 320, into which a corresponding one of the rollers 62 of the second drawer 22 is inserted (see FIG. 6). The roller guide groove 320 may include a horizontal guide section S21, which horizontally extends in the forward-rearward direction. The horizontal guide section S21, which horizontally extends in the forward-rearward direction, is defined by a support surface for supporting the lower side of the roller 62 in the roller guide groove 320. Each of the first support rails 31 includes an inclined section S12, whereas each of the second support rails 32 includes only a horizontal guide section S21, which includes a portion corresponding to the inclined section S12.

The first connection unit 500 is provided to interlock the first drawer 21 and the second drawer 22. The first connection unit 500 may include a lower connection member 510 fixed to the first drawer 21 and an upper connection member 520 fixed to the second drawer 22. Depending on the height of the first drawer 21, the lower connection member 510 and the upper connection member 520 may be connected to or disconnected from each other. Particularly, in the state in which the lower connection member 510 and the upper connection member 520 are connected to each other (i.e., in the state in which the first drawer 21 and the second drawer 22 are interlocked), the roller 61 of the first drawer 21 moves along the inclined section S12 of the first support rail 31. When the lower connection member 510 fixed to the first drawer 21 ascends to a predetermined height or higher, therefore, the lower connection member 510 and the upper connection member 520 may be disconnected from each other.

More specifically, in the state in which the door 3*d* is closed, the lower connection member 510 and the upper connection member 520 are connected to each other. As a result, the base 40, the first drawer 21, and the second drawer 22 simultaneously move until the door 3*d* is opened to the separation angle θe. When the opening angle of the door 3*d* reaches the separation angle θe (i.e., when the roller 61 ascends along the inclined section S12 of the first support rail 31, whereby the lower connection member 510 fixed to the first drawer 21 ascends to a predetermined height ΔP (see FIG. 9) or higher), the connection (or the coupling) between the lower connection member 510 and the upper connection member 520 is released.

Since the second drawer 22 is horizontally guided along the second support rail 32, the upper connection member 520 is continuously located at a constant height. Since the first drawer 21 ascends in the inclined section S12, however, the lower connection member 510 also ascends. That is, the first connection unit 500 may be configured such that the lower connection member 510 moves in the state of being connected with the upper connection member 520, and when the lower connection member 510 ascends to a predetermined height or higher, the lower connection member 510 is disconnected from the upper connection member 520.

More specifically, the upper connection member 520 may include a protrusion support part 521 located at the lower side of the second drawer 22 and a connection protrusion 522 protruding upward from the top surface of the protrusion support part 521. The lower connection member 510 may include a protrusion connection part 511, located at the upper side of the protrusion support part 521 and having therein a protrusion insertion hole 511*h*, into which the connection protrusion 522 is inserted upward.

The lower connection member 510 may include a first coupling part 512, which is coupled to the upper end of the rear surface 211 of the first drawer 21, and a first sidewall part 513, which extends upward from the side end of the first coupling part 512 and from the upper end of which the protrusion connection part 511 extends in the lateral direction. The protrusion connection part 511 is located at the upper side of the first coupling part 512 by the length of the first sidewall part 513 in the upward-downward direction, whereby a recess 510*h*, through which the protrusion support part 521 may extend in the forward-rearward direction, is formed between the protrusion connection part 511 and the first coupling part 512.

The upper connection member 520 may include a second coupling part 523, which is coupled to the bottom surface of the second drawer 22, a front protrusion 524, which extends forward from the second coupling part 523, and a second sidewall part 525, which extends from the front protrusion 524 and from the lower end of which the protrusion support part 521 extends in the lateral direction.

When the second drawer 22 is longer than the first drawer 21 in the forward-rearward direction and the front ends of the first drawer 21 and the second drawer 22 are arranged at predetermined positions, the rear end of the second drawer 22 is located further rearward than the first drawer 21. Even when the second coupling part 523 is coupled to the rear of the second drawer 22, therefore, the connection protrusion 522 may be inserted into the protrusion insertion hole 511*h*, which is located at the rear of the first drawer 21, since the connection protrusion 522 is located further forward than the second coupling part 523 by the length of the front protrusion 524 in the forward-rearward direction.

FIG. 12 is a view showing the first connection unit 500 in the state in which the door 3*d* is closed. The protrusion support part 521 is located in the recess 510*h*, and the connection protrusion 522 is inserted into the protrusion insertion hole 511*h*. The distance between the front end and the rear end of the protrusion insertion hole 511*h* (i.e., the length of the protrusion insertion hole 511*h* in the forward-rearward direction) may be set such that the connection protrusion 522 and the protrusion insertion hole 511*h* can move relative to each other by a predetermined distance ds in the forward-rearward direction. As shown in FIG. 12, the connection protrusion 522 is spaced apart from the rear end of the protrusion insertion hole 511*h* by the distance ds in the state in which the door 3*d* is closed. Preferably, the connection protrusion 522 is in contact with the front end of the protrusion insertion hole 511*h*. When the door 3*d* is opened in this state, the first drawer 21, which is interlocked with the base 40, moves forward by the distance ds, with the result that the second drawer 22 does not move until the rear end of the protrusion insertion hole 511*h* comes into contact with the connection protrusion 522.

As shown in FIG. 13, the front ends of the first drawer 21 and the second drawer 22 are arranged at the same position in the state in which the door 3*d* is closed (see FIG. 13(*a*)). When the door 3*d* is opened, however, only the first drawer 21 is withdrawn by the distance ds until the opening angle of the door 3*d* reaches a predetermined angle. As shown in FIG. 13(*b*), therefore, the front end of the first drawer 21 is located further forward than the second drawer 22 (i.e., the front end of the first drawer 21 is located at Pi). Consequently, the front ends of the first drawer 21 and the second drawer 22 are arranged in a stepped form. That is, the front end of the first drawer 21 protrudes further than the front end of the second drawer 22. Subsequently, when the door 3*d* is opened further, the drawers 21 and 22 are withdrawn in the state in which the first drawer 21 and the second drawer 22 are arranged in a stepped form. In the case in which the first drawer 21 and the second drawer 22 are arranged in such a stepped form, it is possible for the user to easily check food stored in the first drawer 21, since the portion of the open top surface of the first drawer 21 corresponding to the distance ds is not covered by the second drawer 22 but is exposed.

In some implementations, while the first drawer 21 and the second drawer 22 simultaneously move in the state in which the lower connection member 510 and the upper connection member 520 are coupled (or connected) to each other, the first drawer 21 is guided upward along the inclined section S12 of the first support rail 31, with the result that the first drawer 21 ascends by the predetermined height ΔP (see FIG. 9). At this time, the protrusion connection part 511 of the lower connection member 510, which is coupled to the first drawer 21, also ascends, with the result that the connection protrusion 522 is separated from the protrusion insertion hole 511*h* (see FIG. 14). The separation between the connection protrusion 522 and the protrusion connection part 511 is achieved when the door 3*d* is opened to the separation angle θe. At this time, the roller 61, provided at the first drawer 21, may be located within the inclined section S12 of the first support rail 31.

Figure 15:
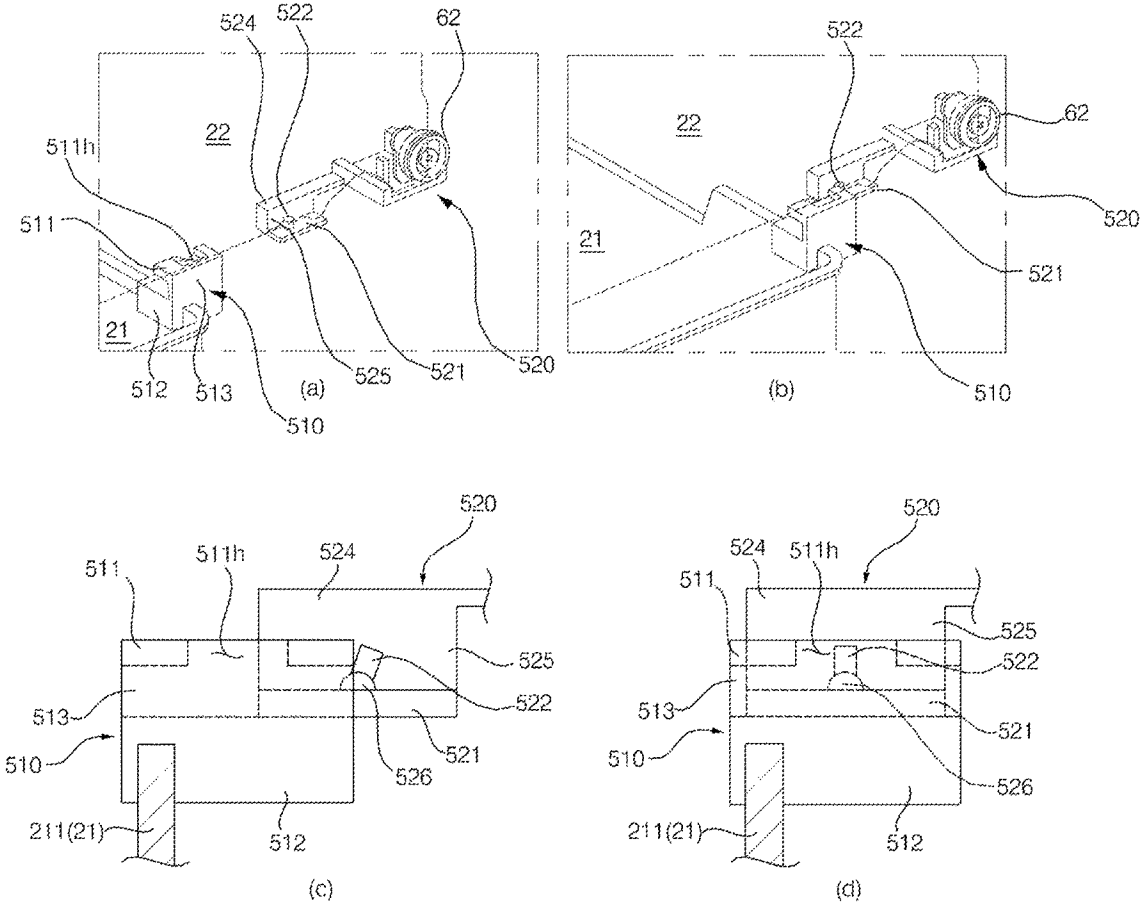
FIG. 15 is a diagram illustrating an example first drawer and an example second drawer when a door of a refrigerator is closed.

FIG. 15 illustrates an example first drawer and an example second drawer when a door of a refrigerator is closed Referring to FIG. 15, the connection protrusion 522 may be connected the protrusion support part 521 via a hinge 526 so as to pivot in the forward-rearward direction. The pivoting operation of the connection protrusion 522 is elastically performed. To this end, the hinge 526 may include an elastic member configured to be deformed in response to the pivoting operation of the connection protrusion 522. The elastic member may be a coil spring or a spiral spring.

FIG. 15(*a*) shows the state in which, after the second drawer 22 is separated from the first drawer 21 (i.e., the connection protrusion 522 is separated from the protrusion insertion hole 511*h*), the second drawer 22 is pushed rearward by the user such that the second drawer 22 returns to the original position thereof. In this case, when the door 3*d* is closed again, the first drawer 21 moves rearward together with the base 40, as described above. At this time, the first drawer 21 descends along the inclined section S12 of the first support rail 31, with the result that the protrusion connection part 511 also descends. When the door 3*d* is continuously turned to be closed, the first drawer is guided along the rear guide section S11 of the first support rail 31. At this time, the rear end of the protrusion connection part 511 comes into contact with the connection protrusion 522 (see FIG. 15(*b*)), and the connection protrusion 522 is rotated rearward by the pushing force applied by the rear end of the protrusion connection part 511 (see FIG. 15(*c*), showing the state in which the connection protrusion 522 is rotated in the clockwise direction). When the first drawer 21 continuously moves rearward, the contact between the protrusion connection part 511 and the connection protrusion 522 is released. When the protrusion insertion hole 511*h* reaches an appropriate position at the upper side of the connection protrusion 522, the connection protrusion 522 is returned to the original position thereof by the restoring force of the elastic member, with the result that the connection protrusion 522 is inserted into the protrusion insertion hole 511*h* (see FIG. 15(*d*)).

Depending on the position at which the rear end of the protrusion connection part 511 contacts the connection protrusion 522 (e.g. the position at which the roller 62 of the second drawer 22 is spaced apart from the end of the horizontal guide section S21 of the second support rail 32) and the coefficient of elasticity of the elastic member, the connection protrusion 522 may be pushed to the rear of the second drawer 22 in the state of being in contact with the rear end of the protrusion connection part 511. In this case, when the roller 62 reaches the end of the horizontal guide section S21 of the second support rail 32, the second drawer 22 does not move any further rearward. That is, the position of the second drawer 22 is fixed. When the door 3*d* is continuously turned so as to be closed in this state, the connection protrusion 522 is rotated rearward by the pushing force applied by the protrusion connection part 511, with the result that the connection protrusion 522 is inserted into the protrusion insertion hole 511*h*. In the state in which the door 3*d* is completely closed, therefore, the connection protrusion 522 may be continuously located in the protrusion insertion hole 511*h*.

In some implementations, when the door 3*d* is opened, the first drawer 21 moves forward, with the result that the rear end of the protrusion insertion hole 511*h* pushes the connection protrusion 522 forward. At this time, it is necessary to prevent the connection protrusion 522 from being rotated by the pushing force applied by the rear end of the protrusion insertion hole 511*h*, and therefore it is preferable to design the hinge 526 in order to satisfy the above-mentioned conditions. For example, the hinge 526 may be configured to allow the connection protrusion 522 to be rotated rearward, as shown in FIG. 15(*c*), but to prevent the connection protrusion 522 from being rotated forward in the state in which the connection protrusion 522 returns to the original position thereof (see FIG. 15(*d*)). Alternatively, the hinge 526 may be configured to allow the connection protrusion 522 to be rotated forward only when forward rotational force greater than rearward rotational force is applied to the connection protrusion 522.

Figure 16:
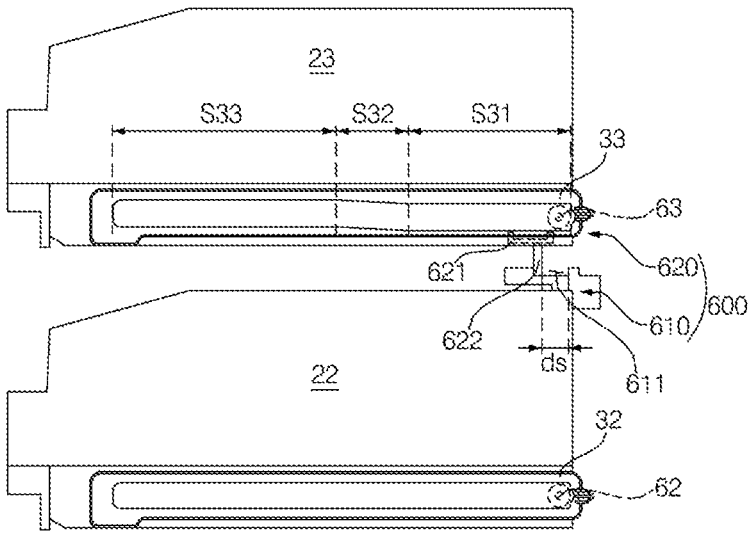
FIGS. 16(*a*) and 16(*b*) are diagrams illustrating an example second drawer and an example third drawer.
Figure 16:
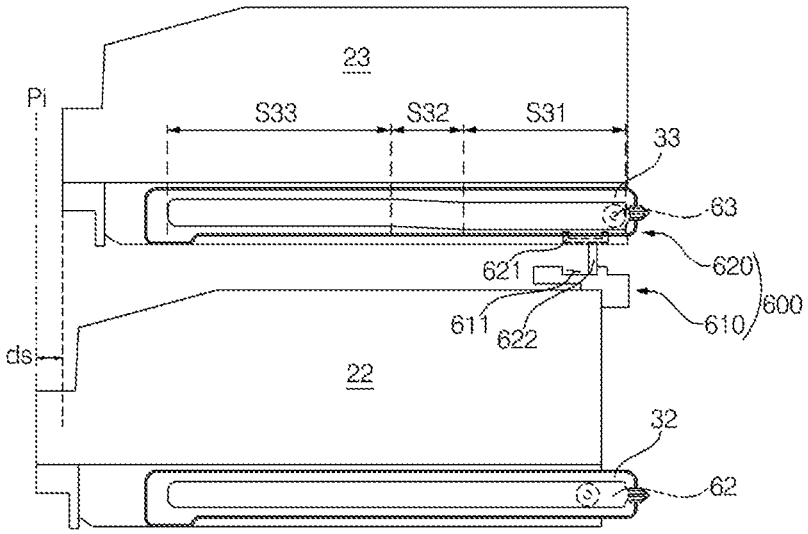
Figure 17:
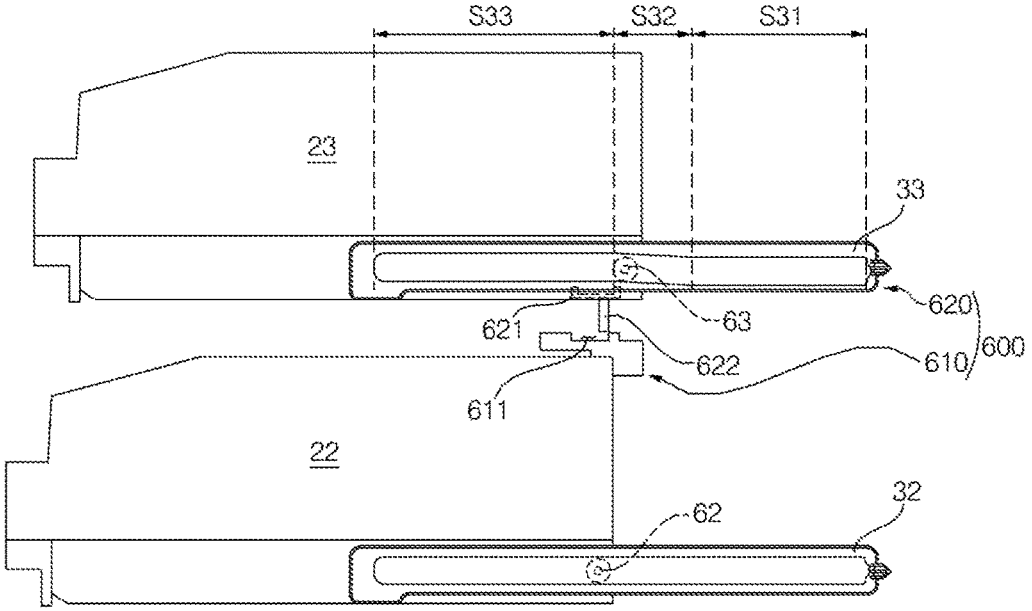
FIG. 17 is a diagram illustrating an example second drawer and an example third drawer when a door of a refrigerator is open to a separation angle.

FIGS. 16(*a*) and 16(*b*) illustrate an example second drawer and an example third drawer. In FIG. 16(*a*), the second drawer 22 is connected to the third drawer 23 when the door 3*d* is closed. In FIG. 16(*b*), the door 3*d* is open to a predetermined angle and the front ends of the second drawer 22 and the third drawer 23 are arranged in a stepped form. FIG. 17 is a diagram illustrating an example second drawer and an example third drawer when a door of a refrigerator is open to a separation angle θe.

Referring to FIGS. 16 and 17, each of the third support rails 33 may include a roller guide groove 330, which includes a rear horizontal section S31, an inclined section S32, and a front horizontal section S33, in the same manner as in each of the first support rails 31.

A second connection unit 600 is provided to interlock the second drawer 22 with the third drawer 23. The second connection unit 600 may include a lower connection member 610 fixed to the second drawer 22 and an upper connection member 620 fixed to the third drawer 23. Depending on the height of the third drawer 23, the lower connection member 610 and the upper connection member 620 may be connected to or disconnected from each other. Particularly, in the state in which the lower connection member 610 and the upper connection member 620 are connected to each other (i.e., in the state in which the second drawer 22 and the third drawer 23 are interlocked), the roller 63 of the third drawer 23 moves along the inclined section S32 of the third support rail 33. When the upper connection member 620, which is fixed to the third drawer 23, ascends to a predetermined height or higher, therefore, the lower connection member 610 and the upper connection member 620 may be disconnected from each other.

More specifically, in the state in which the door 3*d* is closed, the lower connection member 610 and the upper connection member 620 are connected to each other (see FIG. 16(*a*)). As a result, the base 40, the first drawer 21, the second drawer 22, and the third drawer 23 simultaneously move until the door 3*d* is opened to the separation angle θe. The structure in which the base 40, the first drawer 21, and the second drawer 22 are interlocked has been previously described. Hereinafter, the structure in which the second drawer 22 and the third drawer 23 are interlocked will be described.

When the door 3*d* is opened to the separation angle θe in the closed state (i.e., when the roller 63 ascends along the inclined section S32 of the third support rail 33, whereby the upper connection member 620, which is fixed to the third drawer 23, ascends to a predetermined height ΔP or higher), the connection (or the coupling) between the lower connection member 610 and the upper connection member 620 is released. From this time, the third drawer 23 does not advance any further even when the door 3*d* is further opened.

Since the second drawer 22 is horizontally guided along the second support rail 32, the upper connection member 520 is continuously located at a constant height. Since the third drawer 23 ascends in the inclined section S32, however, the upper connection member 620 also ascends. That is, the second connection unit 600 may be configured such that the upper connection member 620 moves in the state of being connected with the lower connection member 610, and when upper connection member 620 ascends to a predetermined height or higher, the upper connection member 620 is disconnected from the lower connection member 610.

More specifically, the upper connection member 620 may include a coupling mount 621 coupled to the bottom surface of the third drawer 23 and a connection protrusion 622 protruding downward from the coupling mount 621.

The lower connection member 610 may be coupled to the rear surface of the second drawer 22, and may be located lower than the coupling mount 621. A protrusion insertion recess 611, which is open upward, may be formed in the top surface of the lower connection member 610.

As shown in FIG. 16(*a*), the connection protrusion 622 may be located in the protrusion insertion recess 611 in the state in which the door 3*d* is closed. At this time, the roller 63 of the third drawer 23 is located within the rear horizontal section S31.

The connection protrusion 622 is spaced apart from the rear end of the protrusion insertion recess 611 by the distance ds in the state in which the door 3*d* is closed. Preferably, the connection protrusion 622 is in contact with the front end of the protrusion insertion recess 611 (see FIG. 16(*a*)). When the door 3*d* is opened in this state, the second drawer 22 moves, whereby the rear end of the protrusion insertion recess 611 advances by the distance ds, with the result that the third drawer 23 does not move until the rear end of the protrusion insertion recess 611 comes into contact with the connection protrusion 622. That is, the second drawer 22 and the third drawer 23 may be withdrawn in the state of being arranged in a stepped form, in the same manner as in the case in which the first drawer 21 and the second drawer 22 are withdrawn in the state of being arranged in a stepped form (see FIG. 16(*b*)).

Referring to FIG. 17, while the second drawer 22 and the third drawer 23 simultaneously move in the state in which the lower connection member 610 and the upper connection member 620 are coupled to each other, the third drawer 23 is guided upward along the inclined section S32 of the third support rail 33, with the result that the third drawer 23 ascends by the predetermined height. At this time, the upper connection member 620, which is coupled to the third drawer 23, also ascends, with the result that the connection protrusion 622 is separated from the protrusion insertion recess 611. The separation between the connection protrusion 622 and the protrusion insertion recess 611 is achieved when the opening angle of the door 3*d* reaches the separation angle θe. At this time, the roller 63, provided at the third drawer 23, may be located within the inclined section S32 of the third support rail 33.

Figure 18:
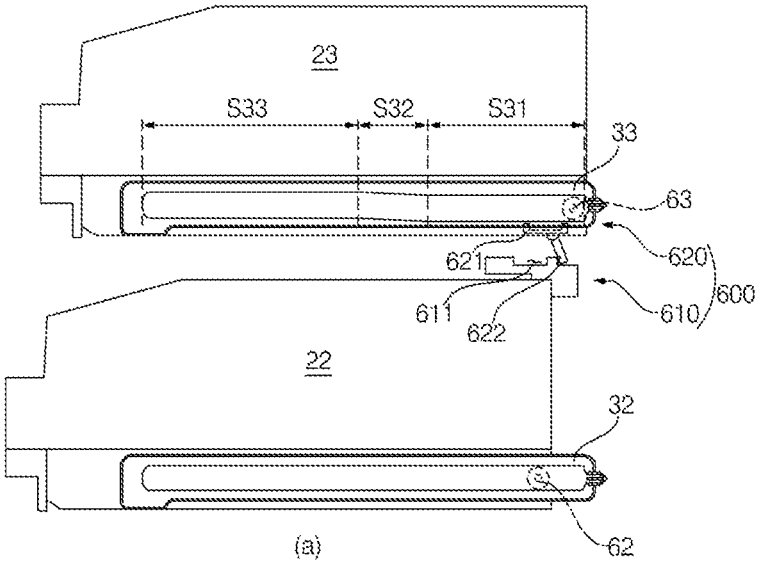
FIG. 18 is a diagram illustrating an example third drawer and an example second connection unit.
Figure 18:
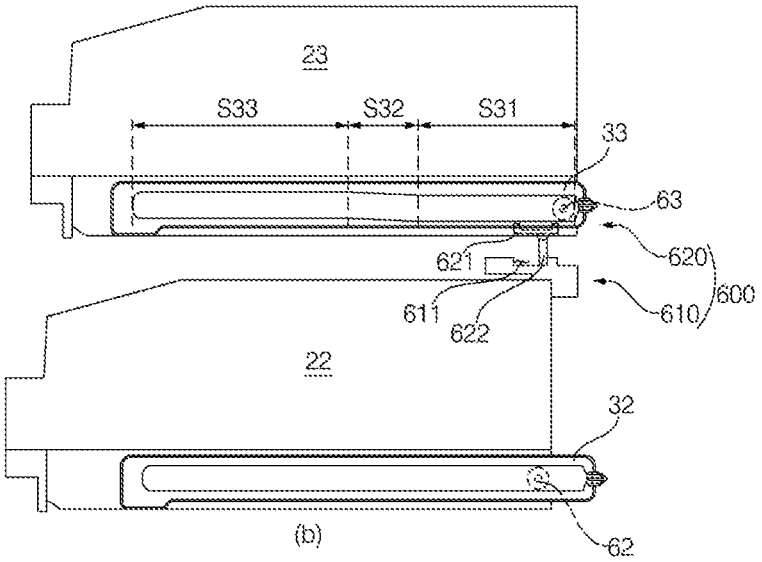

FIG. 18 illustrates an example third drawer and an example second connection unit. Referring to FIG. 18, the connection protrusion 622 may pivot in the forward-rearward direction, like the connection protrusion 522 of the first connection unit 500. The pivoting operation of the connection protrusion 622 is elastically performed. To this end, the upper connection member 620 may include a hinge 625 for pivotally connecting the connection protrusion 622 to the coupling mount 621. The hinge 625 may include an elastic member configured to be deformed in response to the pivoting operation of the connection protrusion 622, in the same manner as in the hinge 526 of the first connection unit 500. The elastic member may be a coil spring or a spiral spring.

In FIG. 18(*a*), the door 3*d* is closed when the third drawer 23 is pushed rearward by the user such that the third drawer 23 returns to the original position and the second drawer 32 is inserted rearward together with the base 40 and the first drawer 21. In this example, the roller 63 of the third drawer 23 is located within the rear horizontal section S31 of the third support rail 33.

As previously described, the second drawer 22 may move rearward in the state of being connected to the first drawer 21. For example, when the door 3*d* is completely opened from the closed state, the connection protrusion 215 of the first drawer 21 is separated from the protrusion insertion groove 45 of the base 40, and the lower connection member 510 and the upper connection member 520 of the first connection unit 500 are separated from each other. When the door 3*d* is closed again, the connection protrusion 215 of the first drawer 21 is inserted into the protrusion insertion groove 45 of the base 40 while the base 40 is moved rearward by the link 70, whereby the base 40 and the first drawer 21 are interlocked. In addition, the roller 61 of the first drawer 22 descends along the inclined section S12 of the first support rail 31, with the result that the lower connection member 510 and the upper connection member 520 of the first connection unit 500 are connected to each other.

When the door 3*d* is closed, as described above, the second drawer 22 is interlocked with the first drawer 21, and the lower connection member 610 of the second connection unit 600 comes into contact with the connection protrusion 622 (at this time, the roller 63 of the third drawer 23 may be located within the rear horizontal section S31). When the second drawer 22 moves further rearward along the second support rail 32, the connection protrusion 622 is rotated rearward by the pushing force applied by the lower connection member 610 (see FIG. 18(*a*), in which the connection protrusion 622 is rotated in the counterclockwise direction). When the second drawer 22 continuously moves rearward, the connection protrusion 622 is returned to the original position thereof by the restoring force of the elastic member, with the result that the connection protrusion 622 is inserted into the protrusion insertion recess 611 (see FIG. 18(*b*)).

When the door 3*d* is opened, the second drawer 22 moves forward, with the result that the rear end of the protrusion insertion recess 611 pushes the connection protrusion 622 forward. At this time, it is necessary to prevent the connection protrusion 622 from being rotated by the pushing force applied by the rear end of the protrusion insertion recess 611, and therefore it is preferable to design the hinge 625 in order to satisfy the above-mentioned conditions.

For example, the hinge 625 may be configured to allow the connection protrusion 622 to be rotated rearward, as shown in FIG. 18(*a*), but to prevent the connection protrusion 622 from being rotated forward in the state in which the connection protrusion 622 returns to the original position thereof (see FIG. 18(*b*)). Alternatively, the hinge 625 may be configured to allow the connection protrusion 622 to be rotated forward only when forward rotational force greater than rearward rotational force is applied to the connection protrusion 622.

What is claimed is:

1. A refrigerator comprising:

a cabinet that includes a storage compartment and an opening on a first surface of the storage compartment;

a door that is coupled to the cabinet and that is configured to open or close the opening, the door movable between an initial position and a secondary position;

a first drawer that is located in the storage compartment and that is configured to store food;

a plurality of first rollers, each of the plurality of first rollers being coupled to a first side of the first drawer or a second side of the first drawer;

a plurality of first support rails, each of the plurality of first support rails being coupled to a first side of the storage compartment or a second side of the storage compartment, and each of the plurality of first support rails being configured to guide one or more of the plurality of first rollers;

a base that is located at a third side of the first drawer in the storage compartment and that moves the base between a first position and a second position; and a withdrawal unit that moves the base between the first position and the second position based on movement of the door between the initial position and the secondary position, respectively, wherein the base includes first one of a connection protrusion and a protrusion insertion groove, the first drawer includes a second one of the connection protrusion and the protrusion insertion groove, the connection protrusion being selectively coupled to and uncoupled from the protrusion insertion groove based on a distance between the first drawer and the base, wherein each of the plurality of first support rails includes an inclined section that guides one or more of the plurality of first rollers and gradually changes a height of the first drawer as one or more of the plurality of first rollers moves in the inclined section, thereby changing the distance between the first drawer and the base, wherein, when the door is in the initial position, the connection protrusion and the protrusion insertion groove are coupled together such that the base is configured to move together with the first drawer, and wherein, when the door moves from the initial position to the secondary position, one or more of the plurality of first rollers moves in a corresponding one or more of the inclined sections of the plurality of first support rails as the base moves from the first position to the second position, thereby changing the height of the first drawer and changing the distance between the first drawer and the base such that the connection protrusion separates from the protrusion insertion groove.

2. The refrigerator of claim 1, wherein each of the plurality of first support rails further includes:

a first section that extends from a first portion of the inclined section.

3. The refrigerator of claim 2, wherein each of the plurality of first support rails further includes:

a second section that extends from a second portion of the inclined section.

4. The refrigerator of claim 1, wherein the connection protrusion protrudes from a first surface of the base and the protrusion insertion groove is located on a first surface of the first drawer.

5. The refrigerator of claim 4, wherein a first end of the first drawer is located in the storage compartment based on one or more of the plurality of first rollers being located in at least one of the inclined sections of the plurality of first support rails.

6. The refrigerator of claim 1, wherein the connection protrusion protrudes from a first surface of the first drawer and the protrusion insertion groove is located on a first surface of the base.

7. The refrigerator of claim 6, wherein a first end of the first drawer is located in the storage compartment based on one or more of the plurality of first rollers being located in at least one of the inclined sections of the plurality of first support rails.

8. The refrigerator of claim 1, further comprising:

a second drawer that is located at a fourth side of the first drawer in the storage compartment and that is configured to store food;

a plurality of second rollers, each of the plurality of second rollers being coupled to a first side of the second drawer or a second side of the second drawer;

a plurality of second support rails, each of the plurality of second support rails being coupled to the first side of the storage compartment or the second side of the storage compartment, and each of the plurality of second support rails being configured to guide one or more of the plurality of second rollers; and a first connection unit that is configured to selectively couple and uncouple the first drawer and the second drawer based on changing the height of the first drawer.

9. The refrigerator of claim 8, wherein the first connection unit includes:

a first connection member that is coupled to the first drawer, and a second connection member that is coupled to the second drawer, wherein, based on the first connection member and the second connection member being in a coupled state, the first drawer is coupled to the second drawer, and wherein, based on the first connection member and the second connection member being in an uncoupled state, the first drawer is uncoupled from the second drawer.

10. The refrigerator of claim 9, wherein the second connection member includes:

a protrusion support part that is located at a third side of the second drawer, and a connection protrusion that protrudes from a surface of the protrusion support part, and wherein the first connection member includes a protrusion insertion hole that is located at a first side of the protrusion support part and into which the connection protrusion of the second connection member is inserted.

11. The refrigerator of claim 10, wherein the connection protrusion of the second connection member is separated from the protrusion insertion hole based on movement of one or more of the first rollers moving into the inclined section of at least one of the plurality of the first support rails.

12. The refrigerator of claim 10, wherein the second connection member further includes:

a hinge that is configured to support the connection protrusion of the second connection member, and wherein the connection protrusion is configured to elastically rotate with respect to the protrusion support part.

13. The refrigerator of claim 10, wherein, in the coupled state, the connection protrusion of the second connection member is located in the protrusion insertion hole.

14. The refrigerator of claim 13, wherein, in the uncoupled state, the connection protrusion of the second connection member is spaced apart from the protrusion insertion hole.

15. The refrigerator of claim 8, further comprising:

a third drawer that is located at a fourth side of the second drawer in the storage compartment and that is configured to store food;

a plurality of third rollers, each of the plurality of third rollers being coupled to a first side of the third drawer or a second side of the third drawer;

a plurality of third support rails, each of the plurality of third support rails being coupled to the first side of the storage compartment or the second side of the storage compartment, and each of the plurality of third support rails being configured to guide one or more of the plurality of third rollers, wherein each of the plurality of third support rails includes an inclined section that is configured to guide one or more of the plurality of third rollers and gradually change a height of the third drawer as the one or more of the plurality of third rollers of the third drawer moves in the inclined section of the third support rail; and a second connection unit that is configured to selectively couple and uncouple the second drawer and the third drawer based on changing the height of the third drawer.

16. The refrigerator of claim 1, wherein the withdrawal unit includes:

a link that includes a first portion that is rotatably coupled to the door and a second portion that is rotatably coupled to the base.

17. A refrigerator comprising:

a cabinet that includes a storage compartment and an opening on a first surface of the storage compartment;

a door that is coupled to the cabinet and that is configured to open or close the opening, the door movable between an initial position and a secondary position;

a first drawer that is located in the storage compartment and that is configured to store food;

a plurality of first rollers, each of the plurality of first rollers being coupled to a first side of the first drawer or a second side of the first drawer;

a plurality of first support rails, each of the plurality of first support rails being coupled to a first side of the storage compartment or a second side of the storage compartment, and each of the plurality of first support rails including an inclined section that is configured to: guide one or more of the plurality of rollers, and gradually change a height of the first drawer as the one or more of the plurality of rollers move in the inclined section; and a base that is located at a third side of the first drawer in the storage compartment and that, based on movement of the door between the initial position and the secondary position, moves between a first position and a second position, respectively, wherein the base includes a first one of a connection protrusion and a protrusion insertion groove, and the first drawer includes a second one of the connection protrusion and the protrusion insertion groove, wherein, when the door is in the initial position, the connection protrusion and the protrusion insertion groove are coupled together such that the first drawer is configured to move together with the base, and wherein, when the door moves from the initial position to the secondary position, one or more of the plurality of rollers moves in a corresponding one or more of the inclined sections of the plurality of first supports rails as the base moves from the first position to the second position, thereby changing the height of the first drawer such that the connection protrusion separates from the protrusion insertion groove.

18. The refrigerator of claim 17, further comprising:

a withdrawal unit that is configured to move the base between the first position and the second position based on movement of the door between the initial position and the secondary position, respectively.

19. The refrigerator of claim 17, further comprising:

a second drawer that is located at a fourth side of the first drawer in the storage compartment and that is configured to store food;

a plurality of second rollers, each of the plurality of second rollers being coupled to a first side of the second drawer or a second side of the second drawer;

a plurality of second support rails, each of the plurality of second support rails being coupled to the first side of the storage compartment or the second side of the storage compartment, and each of the plurality of second support rails being configured to guide one or more of the plurality of second rollers; and a first connection unit that is configured to selectively couple or uncouple the first drawer and the second drawer based on changing the height of the first drawer.

20. The refrigerator of claim 19, further comprising:

a third drawer that is located at a fourth side of the second drawer in the storage compartment and that is configured to store food;

a plurality of third rollers, each of the plurality of third rollers being coupled to a first side of the third drawer or a second side of the third drawer;

a plurality of third support rails, each of the plurality of third support rails being coupled to the first side of the storage compartment or the second side of the storage compartment, and each of the plurality of third support rails being configured to guide one or more of the plurality of third rollers, wherein each of the plurality of third support rails includes an inclined section that is configured to guide one or more of the plurality of third rollers and gradually change a height of the third drawer as the third drawer moves in the inclined section of the third support rail; and a second connection unit that is configured to selectively couple and uncouple the second drawer and the third drawer based on changing the height of the third drawer.

* * * * *